US008356442B2

(12) United States Patent
Potterfield et al.

(10) Patent No.: US 8,356,442 B2
(45) Date of Patent: Jan. 22, 2013

(54) ADJUSTABLE SHOOTING RESTS AND SHOOTING REST ASSEMBLIES

(75) Inventors: Russell A. Potterfield, Columbia, MO (US); Robert Joseph Zara, Rocheport, MO (US); Jim Gianladis, Columbia, MO (US); Mark Wasson, Columbia, MO (US); Adam Birk, Lohman, MO (US); Dennis Cauley, Boonville, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

(21) Appl. No.: 13/419,327

(22) Filed: Mar. 13, 2012

(65) Prior Publication Data

US 2012/0174461 A1 Jul. 12, 2012

Related U.S. Application Data

(62) Division of application No. 12/893,917, filed on Sep. 29, 2010, now Pat. No. 8,132,351, which is a division of application No. 11/843,641, filed on Aug. 22, 2007, now Pat. No. 7,823,317.

(60) Provisional application No. 60/839,464, filed on Aug. 22, 2006, provisional application No. 60/891,473, filed on Feb. 23, 2007.

(51) Int. Cl.
*F41A 9/62* (2006.01)

(52) U.S. Cl. ..... 42/94; 73/167; 89/40.06; 89/37.04; 248/688; 248/121

(58) Field of Classification Search ..... 42/94; 73/167; 89/40.06, 37.04, 36.03; 248/688, 689, 121, 248/125.1

See application file for complete search history.

(56) References Cited

U.S. PATENT DOCUMENTS

| | | | |
|---|---|---|---|
| 197,397 | A | 11/1877 | O'Neil |
| 387,411 | A | 8/1888 | Gisel |
| 399,604 | A | 3/1889 | Dufner et al. |
| 499,315 | A | 6/1893 | Borchardt |
| 568,543 | A | 9/1896 | Parks |
| 668,219 | A | 2/1901 | Rock |

(Continued)

FOREIGN PATENT DOCUMENTS

| | | |
|---|---|---|
| DE | 838872 | 5/1952 |

(Continued)

OTHER PUBLICATIONS

1shop2.com *Hoppe's Gunsmith's Fully Adjustable Bench Vise*; 3 pages. The date on which The Hoppe's Gunsmith's Fully Adjustable Bench Vise was first on sale is not known, but is believed to be circa 2004.

(Continued)

*Primary Examiner* — Michael David
(74) *Attorney, Agent, or Firm* — Perkins Coie LLP

(57) ABSTRACT

Adjustable shooting rests and shooting rest assemblies are disclosed herein. In one embodiment, a shooting rest includes a rest assembly for supporting a forestock of a firearm. The rest assembly includes a base member and first and second upright members extending from the base member. A position of each of the first and second upright members is independently adjustable with reference to the base member. The shooting rest also includes a support assembly coupled to the rest assembly to move the rest assembly in a first direction and in a second direction. The first and second directions are in a plane generally transverse to a longitudinal axis of the firearm. The shooting rest further includes a base coupled to the support assembly.

4 Claims, 23 Drawing Sheets

U.S. PATENT DOCUMENTS

| | | | |
|---|---|---|---|
| 691,912 | A | 1/1902 | McClean |
| 718,865 | A | 1/1903 | Northcraft |
| 778,865 | A | 1/1905 | Hyenga |
| 789,909 | A | 5/1905 | Herold |
| 1,033,624 | A | 7/1912 | Schmeisser |
| 1,061,577 | A | 5/1913 | Whitney |
| 1,088,362 | A | 2/1914 | Perkins |
| 1,089,307 | A | 3/1914 | Benet et al. |
| 1,121,945 | A | 12/1914 | Smith |
| 1,145,585 | A | 7/1915 | Hebard |
| 1,175,692 | A | 3/1916 | Boicourt |
| 1,187,325 | A | 6/1916 | Ivey |
| 1,195,777 | A | 8/1916 | Burtin |
| 1,250,215 | A | 12/1917 | Panos |
| 1,256,255 | A | 2/1918 | Porter |
| 1,295,688 | A | 2/1919 | Butler |
| 1,367,353 | A | 2/1921 | Craig |
| 1,457,407 | A | 6/1923 | Stokes |
| 1,488,647 | A | 4/1924 | Quinn |
| 1,491,604 | A | 4/1924 | Fuller |
| 1,639,722 | A | 8/1927 | Whitney |
| 1,693,289 | A | 11/1928 | Warren |
| 1,736,244 | A | 11/1929 | Baker |
| 1,928,871 | A | 10/1931 | Swebilius |
| 1,902,040 | A | 3/1933 | Meyer |
| 1,907,181 | A | 5/1933 | Fey |
| 1,927,876 | A | 9/1933 | Meyer |
| 2,066,218 | A | 12/1936 | Morgan |
| 2,079,510 | A | 5/1937 | King et al. |
| 2,090,930 | A | 8/1937 | Chubb |
| 2,100,514 | A | 11/1937 | Miller |
| 2,121,982 | A | 6/1938 | Pugsley |
| 2,125,353 | A | 8/1938 | Mattson |
| 2,216,766 | A | 10/1940 | Cook |
| 2,232,743 | A | 2/1941 | Swenson |
| 2,297,993 | A | 10/1942 | Tratsch |
| 2,331,372 | A | 10/1943 | Buchanan |
| 2,427,365 | A | 3/1944 | Meister |
| 2,455,644 | A | 6/1944 | Barnes |
| 2,378,545 | A | 6/1945 | Fraser et al. |
| D147,305 | S | 8/1947 | Sloan |
| 2,432,519 | A | 12/1947 | Garand |
| 2,451,266 | A | 12/1948 | Whittemore |
| 2,476,078 | A | 7/1949 | Banks |
| 2,479,354 | A | 8/1949 | Hanson |
| 2,483,089 | A | 9/1949 | Ferguson |
| 2,484,801 | A | 10/1949 | Anderson |
| 2,508,951 | A | 5/1950 | Kazimier |
| 2,510,380 | A | 6/1950 | Clifford |
| 2,517,268 | A | 8/1950 | Wilson |
| 2,582,140 | A | 1/1952 | Leek |
| 2,638,676 | A | 5/1953 | Callahan |
| 2,677,207 | A | 5/1954 | Stewart |
| 2,701,930 | A | 2/1955 | Dolan |
| 2,729,975 | A | 1/1956 | Hawthorne |
| 2,731,829 | A | 1/1956 | Wigington et al. |
| 2,740,530 | A | 4/1956 | Ponder |
| 2,753,642 | A | 7/1956 | Sullivan |
| 2,774,090 | A | 12/1956 | Allinson |
| 2,774,563 | A | 12/1956 | Pribis |
| 2,795,881 | A | 6/1957 | Bellows |
| 2,813,376 | A | 11/1957 | Middlemark |
| 2,817,233 | A | 12/1957 | Dower et al. |
| 2,821,117 | A | 1/1958 | Hultgren |
| 3,013,289 | A | 3/1958 | Sasena |
| 2,847,909 | A | 8/1958 | Kester |
| 2,867,931 | A | 1/1959 | Schreiber |
| 2,874,707 | A | 2/1959 | Koppel |
| 2,877,689 | A | 3/1959 | Pribis |
| 2,894,347 | A | 7/1959 | Woodcock |
| 2,924,881 | A | 2/1960 | Gee |
| 2,924,904 | A | 2/1960 | Amsler |
| 2,924,914 | A | 2/1960 | Garwood |
| 2,975,540 | A | 3/1961 | Lewis |
| 2,999,788 | A | 9/1961 | Morgan |
| 3,011,283 | A | 12/1961 | Lunn et al. |
| 3,012,350 | A | 12/1961 | Wold |
| 3,023,527 | A | 3/1962 | Leek et al. |
| 3,024,653 | A | 3/1962 | Broadway |
| 3,041,938 | A | 7/1962 | Seabrook |
| 3,055,655 | A | 9/1962 | Chelf |
| 3,060,612 | A | 10/1962 | Brown et al. |
| 3,064,976 | A | 11/1962 | Kuhn |
| 3,107,642 | A | 10/1963 | Lakin |
| 3,112,567 | A | 12/1963 | Flanagan |
| 3,125,929 | A | 3/1964 | Peasley |
| 3,128,668 | A | 4/1964 | Dicken |
| 3,137,957 | A | 6/1964 | Ingalls |
| 3,163,420 | A | 12/1964 | Braun |
| 3,175,456 | A | 3/1965 | Goodsell |
| 3,183,617 | A | 5/1965 | Ruger et al. |
| 3,205,518 | A | 9/1965 | Romaine |
| 3,206,885 | A | 9/1965 | Dye |
| 3,225,656 | A | 12/1965 | Flaherty et al. |
| D203,680 | S | 2/1966 | Allison |
| 3,240,103 | A | 3/1966 | Lamont |
| 3,259,986 | A | 7/1966 | Carr |
| 3,283,425 | A | 11/1966 | Boyd |
| 3,283,643 | A | 11/1966 | Mittelsteadt |
| 3,291,317 | A | 12/1966 | Bowen |
| 3,292,293 | A | 12/1966 | Chiasera et al. |
| 3,320,848 | A | 5/1967 | Ponsness |
| 3,323,246 | A | 6/1967 | Loffler |
| 3,327,422 | A | 6/1967 | Harris |
| 3,330,561 | A | 7/1967 | Kandel |
| 3,343,411 | A | 9/1967 | Lee |
| 3,353,827 | A | 11/1967 | Dun, Jr |
| 3,358,504 | A | 12/1967 | Freebairn |
| 3,370,852 | A | 2/1968 | Kandel |
| 3,406,969 | A | 10/1968 | Tisdell et al. |
| 3,423,092 | A | 1/1969 | Kandel |
| D215,311 | S | 9/1969 | Born |
| 3,486,752 | A | 12/1969 | Colvin |
| 3,499,525 | A | 3/1970 | Kanter |
| 3,510,951 | A | 5/1970 | Dow |
| 3,513,604 | A | 5/1970 | Matsunaga et al. |
| 3,536,160 | A | 10/1970 | Brewer |
| 3,550,941 | A | 12/1970 | Spiro et al. |
| 3,556,666 | A | 1/1971 | Lichenstern |
| D220,154 | S | 3/1971 | Irelan |
| 3,572,712 | A | 3/1971 | Vick |
| 3,580,127 | A | 5/1971 | Lee |
| 3,583,556 | A | 6/1971 | Wagner |
| 3,584,820 | A | 6/1971 | Butcher, Sr. |
| 3,587,193 | A | 6/1971 | Lewis |
| 3,608,225 | A | 9/1971 | Manuel |
| 3,609,902 | A | 10/1971 | Casull |
| 3,646,704 | A | 3/1972 | Ellsworth |
| 3,648,909 | A | 3/1972 | Wisecarver |
| 3,680,266 | A | 8/1972 | Shiplov |
| 3,680,354 | A | 8/1972 | Phillips, Jr. |
| 3,711,955 | A | 1/1973 | Holt |
| 3,711,984 | A | 1/1973 | Dyer et al. |
| 3,736,243 | A | 5/1973 | Duggan |
| 3,738,101 | A | 6/1973 | Simon-Vermot |
| 3,739,515 | A | 6/1973 | Koon, Jr. |
| 3,743,088 | A | 7/1973 | Henkin |
| 3,744,292 | A | 7/1973 | Michelson |
| 3,745,875 | A | 7/1973 | Kennedy et al. |
| 3,748,950 | A | 7/1973 | Huntington |
| 3,764,219 | A | 10/1973 | Collins |
| 3,769,758 | A | 11/1973 | McDonald |
| 3,771,176 | A | 11/1973 | Herman |
| 3,804,238 | A | 4/1974 | Howard |
| 3,813,816 | A | 6/1974 | Funk |
| 3,815,270 | A | 6/1974 | Pachmayr |
| 3,826,559 | A | 7/1974 | Berliner et al. |
| 3,827,172 | A | 8/1974 | Howe |
| 3,842,527 | A | 10/1974 | Low |
| D233,853 | S | 12/1974 | Ferrara |
| 3,876,078 | A | 4/1975 | Gomes et al. |
| 3,877,178 | A | 4/1975 | Campanelli |
| 3,878,939 | A | 4/1975 | Wilcox |
| 3,885,357 | A | 5/1975 | Hoyt |
| 3,893,266 | A | 7/1975 | Anderson et al. |
| 3,895,803 | A | 7/1975 | Loe |
| 3,899,175 | A | 8/1975 | Loe |

3,899,797 A 8/1975 Gunst
D237,106 S 10/1975 Baljet et al.
3,913,746 A 10/1975 Burton
3,914,879 A 10/1975 Taylor, III et al.
3,935,657 A 2/1976 Wade
3,947,988 A 4/1976 Besaw
3,949,987 A 4/1976 Candor
3,961,436 A 6/1976 Hagen et al.
3,964,613 A 6/1976 Anderson, Jr.
3,979,849 A 9/1976 Haskins
4,007,554 A 2/1977 Helmstadter
4,012,860 A 3/1977 Auger
4,021,971 A 5/1977 McFadden
4,026,057 A 5/1977 Cady
4,027,781 A 6/1977 Covert
4,042,242 A 8/1977 Nicholls et al.
4,054,288 A 10/1977 Perrine, Sr.
4,055,016 A 10/1977 Katsenes
4,072,313 A 2/1978 Murso et al.
4,076,247 A 2/1978 Kim et al.
4,090,606 A 5/1978 Dawson
4,120,108 A 10/1978 Vickers et al.
4,120,276 A 10/1978 Curran
4,122,623 A 10/1978 Stice
4,143,491 A 3/1979 Blanc
4,177,608 A 12/1979 Balz
4,188,855 A 2/1980 Alberts
4,203,600 A 5/1980 Brown
4,206,573 A 6/1980 Hayward
4,222,305 A 9/1980 Lee
4,223,588 A 9/1980 Simpson
4,233,748 A 11/1980 Ford et al.
D257,687 S 12/1980 Bechtel
4,266,748 A 5/1981 Dalton
4,266,780 A 5/1981 McQuary
4,282,671 A 8/1981 Wood et al.
D260,650 S 9/1981 Alviti
D261,794 S 11/1981 Bechtel
4,301,625 A 11/1981 Rampe
4,312,146 A 1/1982 Koon, Jr.
4,332,185 A 6/1982 Hargrove
4,333,385 A 6/1982 Culver
4,338,726 A 7/1982 Swailes
4,340,370 A 7/1982 Marshall et al.
4,345,398 A 8/1982 Pickett
4,346,530 A 8/1982 Stewart et al.
4,359,833 A 11/1982 Pachmayr et al.
4,361,989 A 12/1982 Ohno
4,385,464 A 5/1983 Casull
4,385,545 A 5/1983 Duer
4,391,058 A 7/1983 Casull
4,392,321 A 7/1983 Bosworth
4,407,379 A 10/1983 Pryor et al.
4,409,751 A 10/1983 Goda et al.
4,409,826 A 10/1983 Wenger
4,426,085 A 1/1984 Dixon
4,438,913 A 3/1984 Hylia
4,449,314 A 5/1984 Sorensen
4,462,598 A 7/1984 Chalin et al.
4,477,082 A 10/1984 McKenzie et al.
4,480,411 A 11/1984 Balz et al.
4,506,466 A 3/1985 Hall
4,508,508 A 4/1985 Theodore
4,512,101 A 4/1985 Waterman, Jr.
4,522,102 A 6/1985 Pickens
4,526,084 A 7/1985 David et al.
4,540,182 A 9/1985 Clement
4,542,677 A 9/1985 Lee
4,548,392 A 10/1985 Rickling
4,558,531 A 12/1985 Kilby
D283,561 S 4/1986 Geist et al.
4,601,124 A 7/1986 Brown, Jr.
4,608,762 A 9/1986 Varner
4,621,563 A 11/1986 Poiencot
4,625,620 A 12/1986 Harris
4,632,008 A 12/1986 Horner
4,644,987 A 2/1987 Kiang et al.
4,648,191 A 3/1987 Goff et al.
4,653,210 A 3/1987 Poff, Jr.
4,671,364 A 6/1987 Fink et al.
4,674,216 A 6/1987 Ruger et al.
4,695,060 A 9/1987 Pilgrim
4,696,356 A 9/1987 Ellion et al.
4,702,029 A 10/1987 DeVaul et al.
4,715,499 A 12/1987 Howard
4,716,673 A 1/1988 Williams et al.
4,721,205 A 1/1988 Burt et al.
4,723,472 A 2/1988 Lee
4,729,186 A 3/1988 Rieger
4,732,394 A 3/1988 Stein et al.
4,736,843 A 4/1988 Leonard
4,739,996 A 4/1988 Vedder
4,751,963 A 6/1988 Bui et al.
D297,855 S 9/1988 Ruger et al.
4,776,471 A 10/1988 Elkins
4,790,079 A 12/1988 Meyers
4,790,096 A 12/1988 Gibson et al.
4,799,324 A 1/1989 Nodo
4,807,381 A 2/1989 Southard
4,807,888 A 2/1989 Pidde et al.
4,815,593 A 3/1989 Brown
4,819,359 A 4/1989 Bassett
4,821,422 A 4/1989 Porter
4,821,443 A 4/1989 Bianco et al.
4,823,673 A 4/1989 Downing
4,824,086 A 4/1989 Rickling et al.
4,841,839 A 6/1989 Stuart
4,850,151 A 7/1989 Ditscherlein
4,854,066 A 8/1989 Canterbury
4,862,567 A 9/1989 Beebe
D304,223 S 10/1989 Ruger et al.
4,873,777 A 10/1989 Southard
4,890,406 A 1/1990 French
4,890,847 A 1/1990 Cartee et al.
4,896,446 A 1/1990 Gregory
D306,234 S 2/1990 Ferstl et al.
4,903,425 A 2/1990 Harris
4,910,904 A 3/1990 Rose
4,918,825 A 4/1990 Lesh et al.
4,921,256 A 5/1990 Gearhart
4,923,402 A 5/1990 Marshall et al.
4,924,616 A 5/1990 Bell et al.
4,937,965 A 7/1990 Narvaez
D310,302 S 9/1990 Southard
4,967,497 A 11/1990 Yakscoe
4,971,208 A 11/1990 Reinfried, Jr. et al.
4,972,619 A 11/1990 Eckert
4,979,752 A 12/1990 Fosseen
D313,886 S 1/1991 Southard
4,987,694 A 1/1991 Lombardo
4,998,367 A 3/1991 Leibowitz
4,998,944 A 3/1991 Lund
5,005,657 A 4/1991 Ellion et al.
5,009,021 A 4/1991 Nelson
5,014,793 A 5/1991 Germanton et al.
5,031,348 A 7/1991 Carey
5,050,330 A 9/1991 Pilgrim et al.
5,058,302 A 10/1991 Minneman
5,060,410 A 10/1991 Mueller
5,063,679 A 11/1991 Schwandt
5,067,268 A 11/1991 Ransom
5,070,636 A 12/1991 Mueller
5,074,188 A 12/1991 Harris
5,081,783 A 1/1992 Jarvis
5,117,850 A 6/1992 Money
5,123,194 A 6/1992 Mason
5,125,389 A 6/1992 Paff
5,143,340 A 9/1992 Wood et al.
5,149,900 A 9/1992 Buck
5,173,563 A 12/1992 Gray
5,180,874 A 1/1993 Troncoso
5,185,927 A 2/1993 Rivers
5,186,468 A 2/1993 Davies
5,188,371 A 2/1993 Edwards
5,194,678 A 3/1993 Kramer
D335,896 S 5/1993 Evenson
5,211,404 A 5/1993 Grant
5,221,806 A 6/1993 Chaney et al.

5,222,306 A 6/1993 Neumann
5,228,887 A 7/1993 Mayer et al.
5,232,227 A 8/1993 Bateman
5,233,779 A 8/1993 Shaw
5,235,764 A 8/1993 Perazzi et al.
5,237,778 A 8/1993 Baer
5,240,258 A 8/1993 Bateman
5,247,758 A 9/1993 Mason
5,271,175 A 12/1993 West, III
5,275,890 A 1/1994 Wolf et al.
5,287,643 A 2/1994 Arizpe-Gilmore
5,311,693 A 5/1994 Underwood
5,315,781 A 5/1994 Beisner
5,316,579 A 5/1994 McMillan et al.
5,317,826 A 6/1994 Underwood
5,320,217 A 6/1994 Lenarz
5,320,223 A 6/1994 Allen
5,328,029 A 7/1994 Chow et al.
5,332,185 A 7/1994 Walker, III
5,333,829 A 8/1994 Bell et al.
5,335,578 A 8/1994 Lorden et al.
5,337,505 A 8/1994 Brown et al.
5,344,012 A 9/1994 Matthews
5,347,740 A 9/1994 Rather et al.
5,351,428 A 10/1994 Graham
5,358,254 A 10/1994 Yeh et al.
5,361,505 A 11/1994 Faughn
5,367,232 A 11/1994 Netherton et al.
5,370,240 A 12/1994 Hand
5,375,337 A 12/1994 Butler
5,375,377 A 12/1994 Kenton
5,377,437 A 1/1995 Underwood
5,392,553 A 2/1995 Carey
5,394,983 A 3/1995 Latulippe et al.
5,402,595 A 4/1995 Tamllos
5,406,733 A 4/1995 Tarlton et al.
5,410,833 A 5/1995 Paterson
5,414,949 A 5/1995 Peebles
D359,392 S 6/1995 Bellington
5,421,115 A 6/1995 McKay
5,433,010 A 7/1995 Bell
5,433,451 A 7/1995 De Vries
5,435,223 A 7/1995 Blodgett et al.
5,442,860 A 8/1995 Palmer
D362,116 S 9/1995 Bellington et al.
5,446,987 A 9/1995 Lee et al.
D364,080 S 11/1995 Weyrauch
5,481,817 A 1/1996 Parker
5,482,241 A 1/1996 Oglesby
5,486,135 A 1/1996 Arpaio
5,490,302 A 2/1996 Dion
5,491,921 A 2/1996 Allen
5,497,557 A 3/1996 Martinsson et al.
5,497,575 A 3/1996 Fried
5,501,467 A 3/1996 Kandel
D369,904 S 5/1996 Taylor
5,525,314 A 6/1996 Hurson
5,540,329 A 7/1996 Vogeley
5,545,855 A 8/1996 Stanfield et al.
5,562,208 A 10/1996 Hasler et al.
D375,538 S 11/1996 Minneman
5,570,513 A 11/1996 Peterson
5,580,063 A 12/1996 Edwards
5,588,242 A 12/1996 Hughes
5,600,913 A 2/1997 Minneman
5,617,666 A 4/1997 Scott
5,622,344 A 4/1997 Gracie
5,628,135 A 5/1997 Cady
D380,116 S 6/1997 Minneman
5,640,944 A 6/1997 Minneman
5,644,862 A 7/1997 Folmer
5,649,465 A 7/1997 Beebe
5,651,207 A 7/1997 Knight
5,653,625 A 8/1997 Pierce et al.
5,661,919 A 9/1997 Pryor
5,662,516 A 9/1997 You
5,666,757 A 9/1997 Helmstadter
D387,123 S 12/1997 Hughes et al.
5,703,317 A 12/1997 Levilly et al.
5,711,102 A 1/1998 Plaster et al.
5,711,103 A 1/1998 Keng
5,715,625 A 2/1998 West
D391,616 S 3/1998 Plybon
5,723,183 A 3/1998 Williams et al.
5,723,806 A 3/1998 Odom
5,725,096 A 3/1998 Winnard
5,737,865 A 4/1998 Brandl et al.
5,740,625 A 4/1998 Jenkins
5,743,395 A 4/1998 Backer
5,758,447 A 6/1998 Venetz
5,758,933 A 6/1998 Clendening
5,761,954 A 6/1998 Dvorak
5,778,589 A 7/1998 Teague
5,779,527 A 7/1998 Maebashi
5,811,720 A 9/1998 Quinnell et al.
5,813,131 A 9/1998 Werre
5,815,974 A 10/1998 Keng
5,833,308 A 11/1998 Strong, III et al.
D403,176 S 12/1998 Harper
5,845,774 A 12/1998 Hausknecht
5,857,279 A 1/1999 de Oliveira Masina
5,875,580 A 3/1999 Hill et al.
5,878,504 A 3/1999 Harms
5,884,966 A 3/1999 Hill et al.
5,899,329 A 5/1999 Hu et al.
5,907,919 A 6/1999 Keeney
5,913,422 A 6/1999 Cote
5,913,668 A 6/1999 Messer
5,924,694 A 7/1999 Kent
5,930,932 A 8/1999 Peterson
5,933,997 A 8/1999 Barrett
5,933,999 A 8/1999 McClure et al.
5,959,613 A 9/1999 Rosenberg et al.
5,970,642 A 10/1999 Martin
5,974,719 A 11/1999 Simonek
6,019,375 A 2/2000 West, Jr.
6,021,891 A 2/2000 Anderson
6,032,796 A 3/2000 Hopper
6,042,080 A 3/2000 Shepherd et al.
6,044,747 A 4/2000 Felts
6,058,641 A 5/2000 Vecqueray
6,073,381 A 6/2000 Farrar et al.
6,086,375 A 7/2000 Legros
6,092,662 A 7/2000 Frederick
6,110,020 A 8/2000 Rolfi
6,121,556 A 9/2000 Cole
6,237,462 B1 5/2001 Hawkes et al.
6,254,100 B1 7/2001 Rinehart
6,260,463 B1 7/2001 Brand et al.
6,269,578 B1 8/2001 Callegari
6,283,428 B1 9/2001 Maples et al.
6,289,622 B1 9/2001 Desch et al.
6,293,041 B2 9/2001 Weaver
6,294,759 B1 9/2001 Dunn, Jr.
6,305,117 B1 10/2001 Hales, Sr.
6,309,476 B1 10/2001 Ravenscroft et al.
6,338,218 B1 1/2002 Hegler
6,390,294 B1 5/2002 Fiore, Jr. et al.
6,397,720 B1 6/2002 Fox et al.
6,439,515 B1 8/2002 Powers
6,439,530 B1 8/2002 Schoenfish et al.
6,517,133 B2 2/2003 Seegmiller et al.
D471,248 S 3/2003 Jacobs
6,526,687 B1 3/2003 Looney
D473,376 S 4/2003 Abate
6,546,662 B1 4/2003 Chong
6,557,855 B2 5/2003 Wu
6,574,899 B1 6/2003 Mostello
6,575,469 B2 6/2003 Love
6,643,973 B1 11/2003 Smith
6,663,298 B2 12/2003 Haney
6,688,031 B2 2/2004 Steele
6,733,375 B2 5/2004 Hoffman
6,736,400 B1 5/2004 Cesternino
6,813,855 B2 11/2004 Pinkley
6,814,654 B2 11/2004 Rolfi
6,854,975 B2 2/2005 Ranzinger
6,860,054 B1 3/2005 Mosher

| | | | |
|---|---|---|---|
| 6,862,833 | B1 | 3/2005 | Gurtner |
| 6,871,440 | B2 | 3/2005 | Highfill et al. |
| 6,877,266 | B1 | 4/2005 | Brownlee |
| 6,883,263 | B1 | 4/2005 | Carrow |
| 6,931,777 | B1 | 8/2005 | Krien |
| 6,953,114 | B2 | 10/2005 | Wang et al. |
| D513,055 | S | 12/2005 | Lahti |
| 6,978,569 | B2 | 12/2005 | Williamson et al. |
| D519,183 | S | 4/2006 | Minneman |
| 7,032,494 | B2 | 4/2006 | Wygant |
| D521,100 | S | 5/2006 | Morrow |
| 7,062,979 | B2 | 6/2006 | Day et al. |
| D524,541 | S | 7/2006 | Cauley |
| 7,086,192 | B2 | 8/2006 | Deros |
| 7,104,398 | B1 | 9/2006 | Wisecarver |
| 7,134,663 | B1 | 11/2006 | Lowe et al. |
| 7,143,986 | B1 | 12/2006 | Austin et al. |
| 7,152,355 | B2 | 12/2006 | Fitzpatrick et al. |
| 7,152,358 | B1 | 12/2006 | LeAnna et al. |
| 7,159,711 | B1 | 1/2007 | Gardner |
| 7,165,750 | B2 | 1/2007 | McCuskey et al. |
| 7,188,445 | B2 | 3/2007 | Lehman |
| D540,904 | S | 4/2007 | Werner |
| 7,201,376 | B2 | 4/2007 | Kuosa |
| 7,207,567 | B1 | 4/2007 | Brown |
| D543,604 | S | 5/2007 | Minneman |
| 7,213,494 | B2 | 5/2007 | James |
| 7,225,050 | B2 | 5/2007 | Sutula, Jr. |
| D553,219 | S | 10/2007 | Potterfield |
| 7,281,346 | B1 | 10/2007 | Cook et al. |
| D567,895 | S | 4/2008 | Cauley |
| 7,356,960 | B1 | 4/2008 | Knitt |
| 7,356,961 | B2 | 4/2008 | Williams |
| 7,357,250 | B2 | 4/2008 | Hagemann |
| 7,363,740 | B2 | 4/2008 | Kincel |
| 7,367,451 | B2 | 5/2008 | Pendergraph et al. |
| 7,401,431 | B2 | 7/2008 | Pierce et al. |
| 7,410,053 | B2 | 8/2008 | Bowen et al. |
| D576,245 | S | 9/2008 | Potterfield et al. |
| 7,421,815 | B1 | 9/2008 | Moody et al. |
| 7,426,800 | B2 | 9/2008 | Pierce et al. |
| 7,536,820 | B2 | 5/2009 | Wade et al. |
| 7,549,247 | B1 | 6/2009 | Reese |
| 7,584,690 | B2 | 9/2009 | Cauley |
| D605,246 | S | 12/2009 | Hobbs |
| 7,631,455 | B2 | 12/2009 | Keng et al. |
| 7,654,498 | B1 | 2/2010 | Beltz |
| 7,665,241 | B2 | 2/2010 | Oz |
| 7,676,977 | B1 | 3/2010 | Cahill et al. |
| 7,681,886 | B2 | 3/2010 | Morrow et al. |
| 7,694,973 | B1 | 4/2010 | Hofmeister et al. |
| 7,726,478 | B2 | 6/2010 | Potterfield et al. |
| 7,730,824 | B1 | 6/2010 | Black |
| 7,774,972 | B2 | 8/2010 | Potterfield et al. |
| 7,779,572 | B2 | 8/2010 | Potterfield et al. |
| 7,845,267 | B2 | 12/2010 | Potterfield et al. |
| 7,946,071 | B2 | 5/2011 | Cauley et al. |
| 7,954,272 | B2 | 6/2011 | Potterfield et al. |
| 7,997,021 | B2 | 8/2011 | Cauley et al. |
| 8,011,129 | B2 | 9/2011 | Cauley |
| 2002/0113372 | A1 | 8/2002 | Love |
| 2002/0195752 | A1 | 12/2002 | Yang |
| 2003/0079395 | A1 | 5/2003 | Chong |
| 2003/0177685 | A1 | 9/2003 | Pinkley |
| 2003/0234205 | A1 | 12/2003 | McGuyer |
| 2004/0020097 | A1 | 2/2004 | Deros et al. |
| 2004/0112777 | A1 | 6/2004 | Huang |
| 2004/0134113 | A1 | 7/2004 | Deros et al. |
| 2005/0000141 | A1 | 1/2005 | Cauley et al. |
| 2005/0011101 | A1 | 1/2005 | Gooder |
| 2005/0115137 | A1 | 6/2005 | Minneman |
| 2005/0178039 | A1 | 8/2005 | Flores |
| 2005/0183319 | A1 | 8/2005 | Franks |
| 2005/0188597 | A1 | 9/2005 | Keng et al. |
| 2005/0242250 | A1 | 11/2005 | Keng et al. |
| 2006/0063653 | A1 | 3/2006 | Wickens et al. |
| 2006/0070900 | A1 | 4/2006 | Brunson |
| 2006/0174532 | A1 | 8/2006 | Popikow |
| 2006/0175213 | A1 | 8/2006 | Hurt et al. |
| 2006/0218840 | A1 | 10/2006 | Cauley |
| 2006/0236584 | A1 | 10/2006 | Williams |
| 2006/0248774 | A1 | 11/2006 | Pierce et al. |
| 2006/0248775 | A1 | 11/2006 | Wade et al. |
| 2006/0254111 | A1 | 11/2006 | Giauque et al. |
| 2006/0277811 | A1 | 12/2006 | Peterson |
| 2006/0278797 | A1 | 12/2006 | Keng et al. |
| 2007/0029733 | A1 | 2/2007 | Anderson |
| 2007/0046760 | A1 | 3/2007 | Zara |
| 2007/0051028 | A1 | 3/2007 | Stordal |
| 2007/0068379 | A1 | 3/2007 | Sween et al. |
| 2007/0068835 | A1 | 3/2007 | Buie, II |
| 2007/0074439 | A2 | 4/2007 | Cauley et al. |
| 2007/0074440 | A2 | 4/2007 | Cauley |
| 2007/0094911 | A1 | 5/2007 | Rush et al. |
| 2007/0113460 | A1 | 5/2007 | Potterfield et al. |
| 2007/0175077 | A1 | 8/2007 | Laney et al. |
| 2007/0256346 | A1 | 11/2007 | Potterfield et al. |
| 2007/0262529 | A1 | 11/2007 | Gamez et al. |
| 2007/0266610 | A1 | 11/2007 | Coffield |
| 2007/0294929 | A1 | 12/2007 | Potterfield et al. |
| 2007/0294930 | A1 | 12/2007 | Mays |
| 2007/0295197 | A1 | 12/2007 | Potterfield |
| 2008/0023379 | A1 | 1/2008 | Potterfield et al. |
| 2008/0034636 | A1 | 2/2008 | Potterfield et al. |
| 2008/0041700 | A1 | 2/2008 | Potterfield et al. |
| 2008/0047189 | A1 | 2/2008 | Potterfield et al. |
| 2008/0054570 | A1 | 3/2008 | Potterfield et al. |
| 2008/0061509 | A1 | 3/2008 | Potterfield |
| 2008/0127815 | A1 | 6/2008 | Yale et al. |
| 2008/0128002 | A1 | 6/2008 | Jeffs |
| 2008/0156671 | A1 | 7/2008 | Jansson |
| 2008/0163534 | A1 | 7/2008 | Lombardi |
| 2008/0174071 | A1 | 7/2008 | Potterfield et al. |
| 2008/0263928 | A1 | 10/2008 | Potterfield |
| 2009/0020447 | A1 | 1/2009 | Potterfield et al. |
| 2009/0049731 | A1 | 2/2009 | Seuk |
| 2009/0126250 | A1 | 5/2009 | Keng |
| 2010/0032905 | A1 | 2/2010 | Morrow et al. |
| 2010/0102178 | A1 | 4/2010 | Smith et al. |
| 2010/0116163 | A1 | 5/2010 | Zara |
| 2010/0126055 | A1 | 5/2010 | Potterfield et al. |
| 2010/0138032 | A1 | 6/2010 | Potterfield |
| 2010/0236125 | A1 | 9/2010 | Morrow et al. |
| 2010/0270201 | A1 | 10/2010 | Cauley et al. |
| 2011/0024985 | A1 | 2/2011 | Potterfield |
| 2011/0036214 | A1 | 2/2011 | Potterfield |
| 2011/0036236 | A1 | 2/2011 | Potterfield et al. |
| 2011/0079524 | A1 | 4/2011 | Potterfield |
| 2011/0225788 | A1 | 9/2011 | Potterfield |
| 2012/0085012 | A1 | 4/2012 | Potterfield et al. |

FOREIGN PATENT DOCUMENTS

| | | |
|---|---|---|
| EP | 0624455 | 11/1994 |
| GB | 475080 | 11/1937 |

OTHER PUBLICATIONS

AcuSport, Outdoor Sporting Products, 3 pgs., undated.

*American Rifleman: What to do about recoil*, LookSmart, http://www.findarticles.com/p/articles/mi_qa3623/is_199907/ai_n8861959/print, pp. 1-4 [internet accessed on Jan. 4, 2006].

Auto-Flo Lyman Turbo 1200 Tumbler, 2 pages [product photos].

Battenfeld Technologies, Inc., "Gun Vise," Tipton Gun Cleaning Supplies, Battenfeld Technologies, Inc. 2004 Catalog, p. 32, Product No. 782-731, 2 pgs.

Battenfeld Technologies, Inc., "Steady Rest Portable Shooting Rest," 1 page [Internet accessed Jan. 25, 2006].

Big Boy Gun Toys, "Shooting Rest," http://www.bigboyguntoys.com/shootingrest.htm, 1 page [Internet accessed on Jul. 18, 2008].

Birchwood Casey 2005 Catalog, 28 pages.

Birchwood Casey 2006 Catalog. The date of availability of this catalog is unknown, but is believed to be in Jan. 2006 or later. pp. 5-17.

Birchwood Casey, "Dirty Bird@Splattering Targets," http://www.birchwoodcasey.com/sport/target_index.asp?categoryID=4&subcat=22 , pp. 1-4, internet accessed Jan. 16, 2006.

Birchwood Casey, "Shoot•N•C® Targets," http://www.birchwoodcasey.com/sport/target_index.asp?categoryID=4&subcat=8, pp. 1-8, internet accessed Jan. 16, 2006.
Birchwood Casey, "Targets Spots®." http://www.birchwoodcasey.com/sport_index.asp?categoryID=4&subcat=12 , pp. 1-2, internet accessed Jan. 16, 2006.
Birchwood Casey, "World of Targets®" http://www.birchwoodcasey.com/sport/target_index:asp?categoryID=4&subcat=13 , pp. 1-4, internet accessed Jan. 16, 2006.
Boyt Harness Company, Product Catalog, http://www.boytharness.com/catalog/index.php?cPath=22, 2 pages [Internet accessed on Jul. 21, 2008].
Brass Cleaning Kits, http://www.berrysmfg.com/81.php, 1 page [Internet accessed Apr. 24, 2007].
Brownells Inc., Brownells Magna-Tip Screwdriver, Brownells Catalog No. 54 for 2001-2002, 2001, p. 151.
Brownells Inc., Brownells Magna-Tip Super-Sets, Brownells Catalog No. 54 for 2001-2002, 2001, p. 153.
Brownells Inc., Catalog No. 41 1988-1989 3 pages (8909).
Brownells Inc., Catalog No. 47 1994-1995 2 pages (8909).
Brownells Inc., Catalog No. 57. For 2004-2005. 2 pages.
Brownells Inc., Sight Base Cutters, Faxed Dec. 17, 2003, 1 page.
B-Square , Pro Gunsmith Screwdriver Set, B-Square Mounts Tools Accessories Product Catalog, p. 23, date unknown.
Cabela's "Master Catalog Fall 2003: Late-Season Edition" Cover page and page 416. 2 pages.
Cabela's Hunting Fishing and Outdoor Gear Master Catalog, Fall 2002, Edition II, Minimizer Rifle Rest, Item No. SC-22-4332, p. 492.
Cabela's Rotary Media Separator, http://www.cabelas/en/templates/links/link.jsp;jsessionid=QYVQMKM0P0P5 . . . , 2 pages [Internet accessed Apr. 24, 2007].
Cabela's, "BenchBuddy® Gun Rest," http://www.cabelas.com/cabelas/en/templates/links/link.jsp?id=0005819221954a&type=product&cmCat=, © 1996-2008, 2 pages [Internet accessed on Aug. 6, 2008].
Cabela's, "Elite Rifle Rest," http://www.cabelas.com/cabelas/en/templates/links/link.jsp?id=0005817227855a&type=product&cmCat=, © 1996-2008, 2 pages [Internet accessed on Aug. 6, 2008].
Cabela's, "HySkore Sighting System and Cleaning Vise," the date on which the HySkore Sighting System and Cleaning Vise was first on sale is not known, but is believed to be circa Jan. 2005. However, a prototype of this product may have been shown to.
Cabela's, "Hyskore® Dangerous Game™ Machine Rest," http://www.cabelas.com/cabelas/en/templates/links/link.jsp?id=0044091228566a&type=product&cmCat=, © 1996-2008, 2 pages [Internet accessed on Aug. 6, 2008].
Cabela's, "Hyskore® Ultimate Sighting Rest," http://www.cabelas.com/cabelas/en/templates/links/link.jsp?id=0024152226083a&type=product&cmCat=, © 1996-2008, 2 pages [Internet accessed on Aug. 6, 2008].
Cabela's. "Nitro Shoulder Shield Rest," http://www.cabelas.com/cabelas/en/templates/links/link.jsp?id=0040862228231a&type=product&cmCat=, © 1996-2008, 2 pages [Internet accessed on Aug. 6, 2008].
Cabela's, "Premier Rifle Rest," http://www.cabelas.com/cabelas/en/templates/links/link.jsp?id=0020904227856a&type=products&cmCat=. . . , © 1996-2008, 2 pages [Internet accessed on Aug. 6, 2008].
Cabela's, "Secure Bench Rest," http://www.cabelas.com/cabelas/en/templates/links/link.jsp;jsessionid=4F0LP0OW2HMRLLAQBBISCOF.., © 1996-2008, 2 pages [Internet accessed on Aug. 6, 2008].
Cabela's, "Sharp Shooter Auto Magnum Rifle Rest," http://www.cabelas.com/cabelas/en/templates/links/link.jsp?id=0054107229088a&type=product&cmCat=, © 1996-2008, 2 pp. [Internet accessed on Aug. 6, 2008].
Cabela's, "Sharp Shooter Rifle Rest," http://www.cabelas.com/cabelas/en/templates/links/link.jsp?id=0005816222738a&type=product&cmCat=, © 1996-2008, 2 pages [Internet accessed on Aug. 6, 2008].
Cabela's, "Shooting Benches & Portable Rifle Shooting Bench Rest," http://www.cabelas.com/ssubcat-1/cat20793.shtml, 3 pages [Internet accessed Jul. 18, 2008].
Cabela's, "Sure Shot Shooting Vise/Rest," http://www.cabelas.com/cabelas/en/templates/product/standard-item.jsp?id=00348272277 . . . , © 1996-2008, 2 pages [Internet accessed on Jul. 15, 2008].
Caldwell Insta-View™ 4" Targets.
Caldwell Shooting Supplies, 2006 Catalog, pp. 18, 5, 12, 14 and 15.
Caldwell Shooting Supplies, Targets & Target Accessories, Instra-View™ Targets, 1 page.
Caldwells Insta-View 4" Targets, 1 page [product photo].
Californiavarmintcallers.com—Forum, http://californiavarmintcallers.com/community/modules/newbb/viewtopic.php?topic_id=10&forum=9&PHPSESSID=074ed8c7 . . . , pp. 1-4, accessed Jan. 16, 2006.
Canadian Camo, "Gun Rest," http://media5.magma.ca/www.canadiancamo.com/catalog/product_info.php?products_id=. . . , 2 pages [Internet accessed on Feb. 13, 2006].
Carmichael, J., "Reloading for Accuracy," Lyman Reloading Handbook, 46th Edition, pp. 68-77.
Champion Targets, "Next Generation Paper Targets," http://www.championtarget.com/products/targets/next_generation_targets.aspx , pp. 1-3, [internet accessed Jan. 16, 2006].
Champion Traps & Target, 2005 Product Catalog , 12 pages.
Chastain, R., "Load 'em Up!" About.com: Hunting/Shooting, http://hunting.about.com/od/reloadinginfo/a/aaloademup_2htm , 6 pages [Internet accessed on Aug. 31, 2007].
*Cleaning Cradles: Sinclaire Cleaning Cradles* p. 21, The date on which the Sinclair Folding Cleaning Cradle was first on sale is not known, but is believed to be circa 2004.
Cork Industries, Inc., "Double Bumping Coating Applications," Cork Tech TalkNews, Feb. 1997, 2 pages.
CTK Precision, "P3 Ultimate Shooting Rest," http://www.ctkprecision.com/index.asp?PageAction=VIEWPROD&ProdOID=2, 3 pages [Internet accessed on Jul. 18, 2008].
CTK Precision, All Products, http://www.ctkprecision.com/index.asp?PageAction=VIEWCATS&Cate.., 3 pages [Internet accessed on Jul. 22, 2008].
*CTK® P3 Ultimate Shooting Rest*; Amazon.com, Sports & Outdoors, http://www/amazon.com/CTK%C2%AE-P3-Ultimate-Shooting-Rest/dp/ . . . , 1 page [Internet accessed on Jul. 22, 2008].
CV-500, 3 pages [product photos].
*Decker Rifle Vise*, 1 page. The date on which the Decker Rifle Vise was first on sale is not known but is believed to be circa 2004.
Device manufactured by Shooter's Ridge, a division of ATK, and available at least by late 2005, 1 page.
Dillon Precision CV-500 Cartridge Case Vibratory Cleaner, 6 pages [product photos].
E. Arthur Brown Company, "A Shooting Rest that Really Works..," http://www.eabco.com/TargetShooting01.html, © 2007-2008, 1 page [Internet accessed Jul. 18, 2008].
Edgewood Shooting Bags Catalog, http://www.edgebag.com/catalog.php, 7 pages [Internet accessed on Feb. 14, 2006].
Eforcity Magnetic Screwdriver Set w/15 bits Great for Cellphones, Computers Includes: T6, TORX, Security TORX, Philips, Slotted, Spanner, Tri-Wing, Bent Pry Tool, Round Awl, Reset Pin for Game Boy Advance, Nintendo Wii, DS lite, NDS, Apple TV , Amazon.com.
Ellett Brothers, Rests & Gun Vises, pp. 621-622, date unknown.
European Search Report; European Patent Application No. 07863915.0; Filed: Nov. 5, 2007; Applicant: Battenfeld Technologies, Inc.; Mailed on Oct. 14, 2010.
Final Office Action; U.S. Appl. No. 10/865,595; Mailed on Apr. 3, 2007, 10 pages.
Final Office Action; U.S. Appl. No. 11/206,430; Mailed on Apr. 1, 2010, 14 pages.
Final Office Action; U.S. Appl. No. 11/206,430; Mailed on May 12, 2011, 14 pages.
Final Office Action; U.S. Appl. No. 11/206,430; Mailed on Oct. 29, 2007, 13 pages.
Final Office Action; U.S. Appl. No. 11/206,430; Mailed on Nov. 24, 2008, 12 pages.
Final Office Action; U.S. Appl. No. 11/271,100; Mailed on Sep. 22, 2008, 8 pages.
Final Office Action; U.S. Appl. No. 11/339,863; Mailed on Mar. 10, 2009, 6 pages.

Final Office Action; U.S. Appl. No. 11/431,956; Mailed on Nov. 27, 2009, 13 pages.
Final Office Action; U.S. Appl. No. 11/505,784; Mailed on Dec. 19, 2008, 10 pages.
Final Office Action; U.S. Appl. No. 11/507,683; Mailed on Apr. 6, 2010, 7 pages.
Final Office Action; U.S. Appl. No. 11/607,550; Mailed on Nov. 27, 2009, 14 pages.
Final Office Action; U.S. Appl. No. 11/679,100: Mailed on Feb. 18, 2011, 11 pages.
Final Office Action; U.S. Appl. No. 11/679,100; Mailed on Aug. 3, 2009, 9 pages.
Final Office Action; U.S. Appl. No. 11/679,136; Mailed on Apr. 10, 2009, 22 pages.
Final Office Action; U.S. Appl. No. 11/679,832; Mailed on Jun. 8, 2010, 12 pages.
Final Office Action; U.S. Appl. No. 11/801,341; Mailed on Sep. 30, 2009, 6 pages.
Final Office Action; U.S. Appl. No. 11/844,980; Mailed on May 25, 2010, 6 pages.
Final Office Action; U.S. Appl. No. 11/853,763; Mailed on Jul. 13, 2009, 7 pages.
Final Office Action; U.S. Appl. No. 12/177,032; Mailed on Oct. 5, 2010, 11 pages.
Final Office Action; U.S. Appl. No. 12/476,041; Mailed on Jul. 20, 2010, 7 pages.
Final Office Action; U.S. Appl. No. 12/848,649; Mailed on Jan. 18, 2012, 6 pages.
Grafix Plastics, http://grafixplastic.com/plastic_film_g.asp?gclid=CK-5-_7gnY4CFRVNhgodjFhfSQ , 29 pages [Internet accessed on Aug. 30, 2007].
Gun Rest—Shooting Rest—Rifle Rests, http://www.jexploreproducts.com/gunrests-shootingrests.htm, 6 pages [Internet accessed Jul. 18, 2008].
Harris, J. et al., "The Art and Science of Annealing," http://www.6mmbr.com/annealing.html, © 2005, 13 pages [Internet accessed on Aug. 13, 2007].
Hyskore, "Rest—Dangerous Game Machine Rest," Hyskore Rest, Professional firearm rests, http://www.hyskore.com/rests.htm, 2 pages [Internet accessed Jul. 21, 2008].
Hyskore: Professional Shooting Accessories. "Dangerous Game Machine Rest," Accessed Feb. 22, 2006 www.hyskore.com, 10 pages.
Hyskore: Professional Shooting Accessories. "Hydraulic Trigger Release." Accessed Feb. 22, 2006. www.hyskore.com 7 pages.
International Search Report and Written Opinion; International Patent Application No. PCT/US07/76440; Filed: Aug. 21, 2007; Applicant: Battenfeld Technologies, Inc.; Mailed on Sep. 30, 2008.
International Search Report and Written Opinion; International Patent Application No. PCT/US07/76587; Filed: Aug. 22, 2007; Applicant: Battenfeld Technologies, Inc.; Mailed on Jul. 30, 2008.
International Search Report and Written Opinion; International Patent Application No. PCT/US07/83674; Filed: Nov. 5, 2007; Applicant: Battenfeld Technologies, Inc.; Mailed on Jun. 11, 2008.
Joe's, "Shooter's Ridge Steady Point Shooting Rest," http://www.joessport.com/product/index.jsp?productID=3155005&cp=726872&parentpag.., Item No. 3155005, 1 page [Internet accessed Jul. 17, 2008].
Lahti Company Brochure, "Rock Solid Hold," Rifle Evaluator, http://www.lathicompany.com/Forms/EvaluatorBrochure2.jpg, 2 pages. [Internet accessed Jan. 16, 2006].
Lahti Company Brochure, "Rifle Evaluator: No Pain, No Fear, No Flinching, No Body Movement," www.lahticompany.com, 2 pages, undated.
Lee Precision, Inc., "Load-All," 1 page.
Lee Precision, Inc., "The World's Fastest Handloading Press . . . Lee Progressive 1000," 1985 Catalog, pp. 1-15.
Lohman Sight Vise, 4 pages product photographs, the date on which the Lohman Site Vise was first on sale is not known, but is believed to be circa 2004.
Lyman Hornady Case Tumbler, 2 pages [product photos].
Lyman Turbo 600 Tumbler, 3 pages [product photos].
Lyman Turbo Pro 1200 Tumber, 2 pages [product photos].
Lyman, "A History of Lyman Metallic Reloading," Reloading Handbook, 46th Edition, pp. 10-31.
Lyman, "Introduction to Reloading," Reloading Handbook, 46th Edition, pp. 170-203.
MacksPW.com, "Desert Mountain Bench Master Rifle Rest," http://www.macksqw.com/Item--i-DESBM1, © 2004-2008, 1 page [Internet accessed Jul. 22, 2008].
Midway USA, Chapman 27-Piece Deluxe Screwdriver Set, Master Catalog and Reference Guide #2, 2004, p. 440.
Midway USA, Pachmayr Professional Screwdriver Set, Master Catalog and Reference Guide #2, 2004, p. 448.
Midway USA, Wheeler Engineering Space-Saver Gunsmithing Screwdriver Set, Master Catalog and Reference Guide #2, 2004, p. 453.
Midway USA. "Tipton Range Box with Ultimate Rifle, Handgun Cleaning Kit (No Solvents)," http://www.midwayusa.com/rewriteaproduct/135086, The date on which the Tipton Range Box was first on sale is not known, but is believed to be circa 2004, 2 pages.
MidwayUSA, "ADG Rifle Shooting Rest," http://www.midwayusa.com/eproductpage.exe/showproduct?saleitemid=992071&t=11082005, 2005, 3 pages [Internet accessed on Aug. 6, 2008].
MidwayUSA, "Caldwell Full Length Fire Control Shooting Rest," http://www.midwayusa.com/eproductpage.exe/showproduct?saleitemid=683866&t=11082005, 2005, 3 pages [Internet accessed on Aug. 6, 2008].
MidwayUSA, "Caldwell Lead Sled DFT Rifle Shooting Rest," http://www.midwayusa.com/eproductpage.exe/showproduct?saleitemid=149023&t=11082005, 2005, 6 pages [Internet accessed on Aug. 6, 2008].
MidwayUSA, "Caldwell Lead Sled Rifle Shooting Rest," http://www.midwayusa.com/eproductpage.exe/showproduct?saleitemid=152664&t=11082005, 2005, 8 pages [Internet accessed on Aug. 6, 2008].
MidwayUSA, "Caldwell Steady Rest NXT Rifle Shooting Rest," http://www.midwayusa.com/eproductpage.exe/showproduct?saleitemid=838651&t=11082005, 2005, 4 pages [Internet accessed on Aug. 6, 2008].
MidwayUSA, "Caldwell Zero-Max Rifle Shooting Rest," http://www.midwayusa.com/eproductpage.exe/showproduct?saleitemid=726222&t=11082005, 2005, 3 pages [Internet accessed on Aug. 6, 2008].
MidwayUSA, "CTK Precision P3 Ultimate Shooting Rest," http://www.midwayusa.com/eproductpage.exe/showproduct?saleitemid=114699&t=11082005, 2005, 2 pages [Internet accessed on Aug. 6, 2008].
MidwayUSA, "Hyskore® dangerous Game Rifle Shooting Rest," http://www.midwayusa.com/eproductpage.exe/showproduct?saleitemid=729197&t=11082005, 2005, 3 pages [Internet accessed on Aug. 6, 2008].
MidwayUSA, "Hyskore® Precision Gas Dampened Recoil Reducing Rifle Shooting Rest," http://www.midwayusa.com/eproductpage.exe/showproduct?saleitemid=838848&t=11082005, 2005, 4 pages [Internet accessed on Aug. 6, 2008].
MidwayUSA, "Hyskore® Swivel Varmint Rifle Shooting Rest," http://www.midwayusa.com/eproductpage.exe/showproduct?saleitemid=587606&t=11082005, 2005, 3 pages [Internet accessed on Aug. 6, 2008].
MidwayUSA, "Shooters Ridge Steady Point Rifle Shooting Rest and Vise," http://www.midwayusa.com/eproductpage.exe/showproduct?saleitemid=341095&t=11082005, 2005, 4 pages [Internet accessed on Aug. 6, 2008].
MidwayUSA, "Shooters Ridge Steady Point Rifle Shooting Rest," http://www.midwayusa.com/eproductpage.exe/showproduct?saleitemid=826745&t=11082005, 2005, 5 pages [Internet accessed on Aug. 6, 2008].
MidwayUSA, "Shooting Supplies—Shop Everything for Your Firearm at MidwayUSA," http://www.midwayusa.com/browse/BrowseProducts.aspx?categoryStrin . . . , 15 pages [Internet accessed on Jul. 21, 2008].

MidwayUSA, "Stoney Point Bench Anchor Rifle Shooting Rest," http://www.midwayusa.com/eproductpage.exe/showproduct?saleitemid=347174&t=11082005, 2005, 2 pages [Internet accessed on Aug. 6, 2008].
Milek, B., "Handloading for Hunting" New Products from RCBS, Lee, Accurate Arms, Peterson's Hunting, Mar. 1985, p. 21.
Millett, "BenchMaster Shooting Rests," 1 page, Undated.
MTM Case-Gard, "Gun Maintenance Centers," http://www.mtmcase-gard.com/products/shooting/gunm.html, the date on which the MTM Gun Maintenance Center was first on sale is not known, but is believed to be circa 2004, 2 pages. [Internet accessed Oct. 11, 2006].
MTM Case-Gard, "MTM Shoulder-Gard Rifle Rest," Cover Photo for Rest, p. 2, date unknown.
MTM Case-Gard, "Rifle rest and pistol shoot rest," http://www/mtmcase-gard.com/products/shooting/shoo.html, the date on which the MTM Site-In-Clean was first on sale is not known, but is believed to be circa 2004, 3 pages. [Internet accessed on 10/11/20.
Non-Final Office Action; U.S. Appl. No. 10/865,595; Mailed on Jun. 7, 2006, 8 pages.
Non-Final Office Action; U.S. Appl. No. 11/206,430; Mailed on Jun. 23, 2009, 13 pages.
Non-Final Office Action; U.S. Appl. No. 11/206,430; Mailed on Oct. 14, 2010, 18 pages.
Non-Final Office Action; U.S. Appl. No. 11/206,430; Mailed on May 14, 2008, 10 pages.
Non-Final Office Action; U.S. Appl. No. 11/206,430; Mailed on May 21, 2007, 12 pages.
Non-Final Office Action; U.S. Appl. NO. 11/271,100; Mailed on Mar. 26, 2008, 9 pages.
Non-Final Office Action; U.S. Appl. No. 11/311,530; Mailed on Feb. 13, 2007, 10 pages.
Non-Final Office Action; U.S. Appl. No. 11/339,863; Mailed on Sep. 23, 2008, 7 pages.
Non-Final Office Action; U.S. Appl. No. 11/418,407; Maile on Feb. 24, 2009, 9 pages.
Non-Final Office Action; U.S. Appl. No. 11/431,956; Mailed on May 7, 2012, 10 pages.
Non-Final Office Action; U.S. Appl. No. 11/431,956; Mailed on Feb. 9, 2011, 13 pages.
Non-Final Office Action; U.S. Appl. No. 11/431,956; Mailed on Mar. 2, 2009, 16 pages.
Non-Final Office Action; U.S. Appl. No. 11/505,784; Mailed on Oct. 27, 2009, 8 pages.
Non-Final Office Action; U.S. Appl. No. 11/505,784; Mailed on Dec. 26, 2007, 14 pages.
Non-Final Office Action; U.S. Appl. No. 11/507,683; Mailed on Sep. 18, 2008, 8 pages.
Non-Final Office Action; U.S. Appl. No. 11/607,550; Mailed on Jun. 17, 2010, 12 pages.
Non-Final Office Action; U.S. Appl. No. 11/607,550; Mailed on Nov. 23, 2011, 8 pages.
Non-Final Office Action; U.S. Appl. No. 11/607,550; Mailed on Mar. 2, 2009, 11 pages.
Non-Final Office Action; U.S. Appl. No. 11/679,100; Mailed on May 28, 2010, 9 pages.
Non-Final Office Action; U.S. Appl. No. 11/679,100; Mailed on Oct. 16, 2008, 11 pages.
Non-Final Office Action; U.S. Appl. No. 11/679,136; Mailed on Aug. 18, 2008, 6 pages.
Non-Final Office Action; U.S. Appl. No. 11/679,136; Mailed on Aug. 28, 2008, 8 pages.
Non-Final Office Action; U.S. Appl. No. 11/679,169; Mailed on Apr. 28, 2009, 11 pages.
Non-Final Office Action; U.S. Appl. No. 11/679,832; Mailed on Aug. 28, 2009, 9 pages.
Non-Final Office Action; U.S. Appl. No. 11/739,077; Mailed on Oct. 8, 2009, 7 pages.
Non-Final Office Action; U.S. Appl. No. 11/740,908; Mailed on Jan. 29, 2010, 8 pages.
Non-Final Office Action; U.S. Appl. No. 11/746,551; Mailed on Apr. 14, 2010, 8 pages.
Non-Final Office Action; U.S. Appl. No. 11/746,551; Mailed on Jul. 8, 2011, 14 pages.
Non-Final Office Action; U.S. Appl. No. 11/801,341; Mailed on Jan. 13, 2009, 7 pages.
Non-Final Office Action; U.S. Appl. No. 11/844,980; Mailed on Dec. 16, 2010, 9 pages.
Non-Final Office Action; U.S. Appl. No. 11/844,980; Mailed on Aug. 21, 2008, 8 pages.
Non-Final Office Action; U.S. Appl. No. 11/846,408; Mailed on Aug. 18, 2008, 8 pages.
Non-Final Office Action; U.S. Appl. No. 11/853,745; Mailed on Jun. 19, 2009, 11 pages.
Non-Final Office Action; U.S. Appl. No. 11/853,763; Mailed on Dec. 22, 2008, 6 pages.
Non-Final Office Action; U.S. Appl. No. 12/037,336; Mailed on Sep. 15, 2010, 33 pages.
Non-Final Office Action; U.S. Appl. No. 12/117,668; Mailed on Aug. 13, 2009, 15 pages.
Non-Final Office Action; U.S. Appl. No. 12/172,848, Mailed on Nov. 22, 2010, 32 pages.
Non-Final Office Action; U.S. Appl. No. 12/177,032; Mailed on Feb. 23, 2010, 6 pages.
Non-Final Office Action; U.S. Appl. Nol 12/177,032; Mailed on Aug. 15, 2011, 9 pages.
Non-Final Office Action; U.S. Appl. No. 12/209,113; Mailed on Sep. 23, 2009, 6 pages.
Non-Final Office Action; U.S. Appl. No. 12/276,223; Mailed on Jul. 19, 2011, 11 pages.
Non-Final Office Action; U.S. Appl. No. 12/276,223; Mailed on Dec. 27, 2010, 37 pages.
Non-Final Office Action; U.S. Appl. No. 12/276,229; Mailed on Aug. 30, 2010, 8 pages.
Non-Final Office Actio; U.S. Appl. No. 12/476,041; Mailed on Nov. 18, 2009, 6 pages.
Non-Final Office Action; U.S. Appl. No. 12/614,578; Mailed on Dec. 8, 2011, 12 pages.
Non-Final Offcie Action; U.S. Appl. No. 12/769,438; Mailed on Jul. 15, 2011, 55 pages.
Non-Final Office Action; U.S. Appl. No. 12/899,418; Mailed on Jan. 3, 2012, 30 pages.
"Offering the best in Fishing, Hunting and Outdoor Products"; Basspro.com, Bass Pro Shops Outdoors Online; http://www.basspro.com/webapp/wcs/stores/serviet/Product__10151__-1__10001__95064__SearchResults, 2 pages [Internet accessed on Aug. 6, 2008].
Plano Shooters Case, Brown Camo, The Sportsman's Guide, http://www.sportsmansguide.com/cb/cb.asp?a=148225, the date on which the Plano Shooters Case was first on sale is not known but is believed to be circa 2004, 3 pages [Internet accessed no 10/11/200.
Precision Shooting, Inc., Baid Eagle Front Rest, The Accurate Rifle, vol. 6, Issue No. 4, May 2003, p. 47.
Protektor Model, "The Original Leather Rifle and Pistol Rest," http://www.protektormodel.com/, 12 pages [Internet accessed on Feb. 14, 2006].
RCBS Automatic Primer Tool, pp. 68-71, undated.
RCBS, "Reloading Equipment," http://www.rcbs.com/default.asp?menu=1&s1=4&s2=3&s3=25, 1 page [Internet accessed Apr. 24, 2007].
Reloading Manual Number Ten for Rifle and Pistol, The Cartridge Components, SPEER Omark Industries, pp. 28-54.
Shooters Ridge, "Deluxe Rifle Rest," http://www.shootersridge.com, 1 page [Internet accessed Jul. 21, 2008].
Shooters Ridge, "Shooting Rest with Gun Vise," http://www.shootersridge.com, 1 page [Internet accessed Jul. 17, 2008].
Shotshell reloading with a GRABBER, MEC—Mayville Engineering Company, Inc., pp. 1-12.
SHTRS RDG Steady PNT Rifle Rest DLX, Grips/Pads/Stocks, Gun Accessories, Hunting & Shooting Accessories, Hunting Gear, Fishing & Hunting, Amazon.com; http://www.amazon.com/STEADY-Accessories-Hunting-Shooting-Fishin . . . , 1 page [Internet accessed on Jul. 22.

Sinclair International, Sinclair Shooting Rests, Products for the Precision Shooter, 2002, Issue No. 2002-B pp. 76-78.
Stoney Point Adjustable Shooting Rest w/Bag, Sports & Outdoors, Amazon.com; http://www.amazon.com/Stoney-Point-Adjustable-Shooting-Rest/dp/B0, 1 page [Internet accessed on Jul. 22, 2008].
Sweeney, P., "Gunsmithing: Measure Headspace," Peterson's Rifleshooter, http://www.rifleshootermag.com/gunsmithing/headspace_0612/ , 4 pages [Internet accessed Dec. 11, 2004].
Tenex Precision Co., "Recoil A-Rest-R," 4 pages, date unknown [product photos].
The Blue Press, "Dillon Case Preparation Equipment," http://dillonprecision.com/template/p.cfm?maj=16&min=0&dyn=1&, Apr. 2007, 2 pages [Internet accessed Apr. 24, 2007].
The Grabber and Hustler '76, MEC—Mayville Engineering Company, Inc., 2 pgs, date unknown.
Uncle Bud's Bull Bags, http:www.unclebudscss.com/pages/Bulls%20bags.html, 2 pgs. [Internet accessed on Feb. 14, 2006.
Uncle Bud's Udder Bag, http:www.unclebudscss.com/pages/Udder%20Bags.html, 2 pgs. [Internet accessed on Feb. 14, 2006].

ADJUSTABLE SHOOTING RESTS AND SHOOTING REST ASSEMBLIES

CROSS-REFERENCE TO RELATED APPLICATION

This application is a divisional of U.S. patent application Ser. No. 12/893,917, filed Sep. 29, 2010, which is a divisional of U.S. patent application Ser. No. 11/843,641, filed Aug. 22, 2007, now U.S. Pat. No. 7,823,317, which claims the benefit of U.S. Provisional Patent Application No. 60/839,464, filed Aug. 22, 2006, and U.S. Provisional Patent Application No. 60/891,473, filed Feb. 23, 2007, the disclosures of which are incorporated herein by reference in their entirety.

TECHNICAL FIELD

The present disclosure is directed generally to shooting rests and associated assemblies.

BACKGROUND

Shooters often use firearm rests or supports to steady a firearm during target practice and accuracy testing. Holding a firearm without a stable support may not provide the required repeatability to determine the accuracy of the firearm. Many shooters accordingly use a support in an attempt to reduce or eliminate human movement inherent from holding the firearm. For example, shooters may place the forestock of a rifle on a front support and the buttstock of the rifle on a rear support. Alternatively, shooters may hold the buttstock and use a support only for the forestock of the rifle.

In addition to supporting the firearm, shooters may also want to adjust the position of the firearm between shots. For example, sighting a firearm involves repeatedly firing the firearm at a specific location (i.e., bull's-eye) on a target. After identifying where the bullet hits the target, the shooter may adjust the firearm or sighting mechanism according to any deviation from the bull's-eye. One challenge associated with adjusting the firearm position, however, is the effect of a minor adjustment of the position of a firearm. Slightly changing the angle of the barrel of a firearm, for example, may greatly influence the trajectory of the bullet. Moreover, the greater the distance a target is from the firearm, the greater the effect of the adjustment of the firearm on the bullet's destination. As such, firearm supports with course adjustment mechanisms or unsteady supports may not provide the required adjustability for sighting or target practice, especially for targets that are located a considerable distance (e.g., 50-100 yards or more) from the firearm. Additionally, recoil between shots may require further adjustments between shots, thus making repeatability more difficult.

Existing adjustable firearm supports may be obtained from the following companies: Farley Manufacturing (http://farleymfg.com/); H&J Engineering (http://benchrestjoystick-.com/); Shadetree Engineering & Accuracy (http://www.shadetreeea.com/); and Sebastian Lambang Supandi (http://www.sebcoax.com/). The rests available from these companies are generally configured to support only the forestock of a firearm. These rests also appear to include non-sliding "ears" or upright members configured to receive the forestock of the firearm. Moreover, these rests appear to be composed of individual components machined from solid materials. In addition, separate tools are required to adjust a sensitivity of the adjustability mechanisms of these rests.

DETAILED DESCRIPTION

A. Overview

Figure 1A:
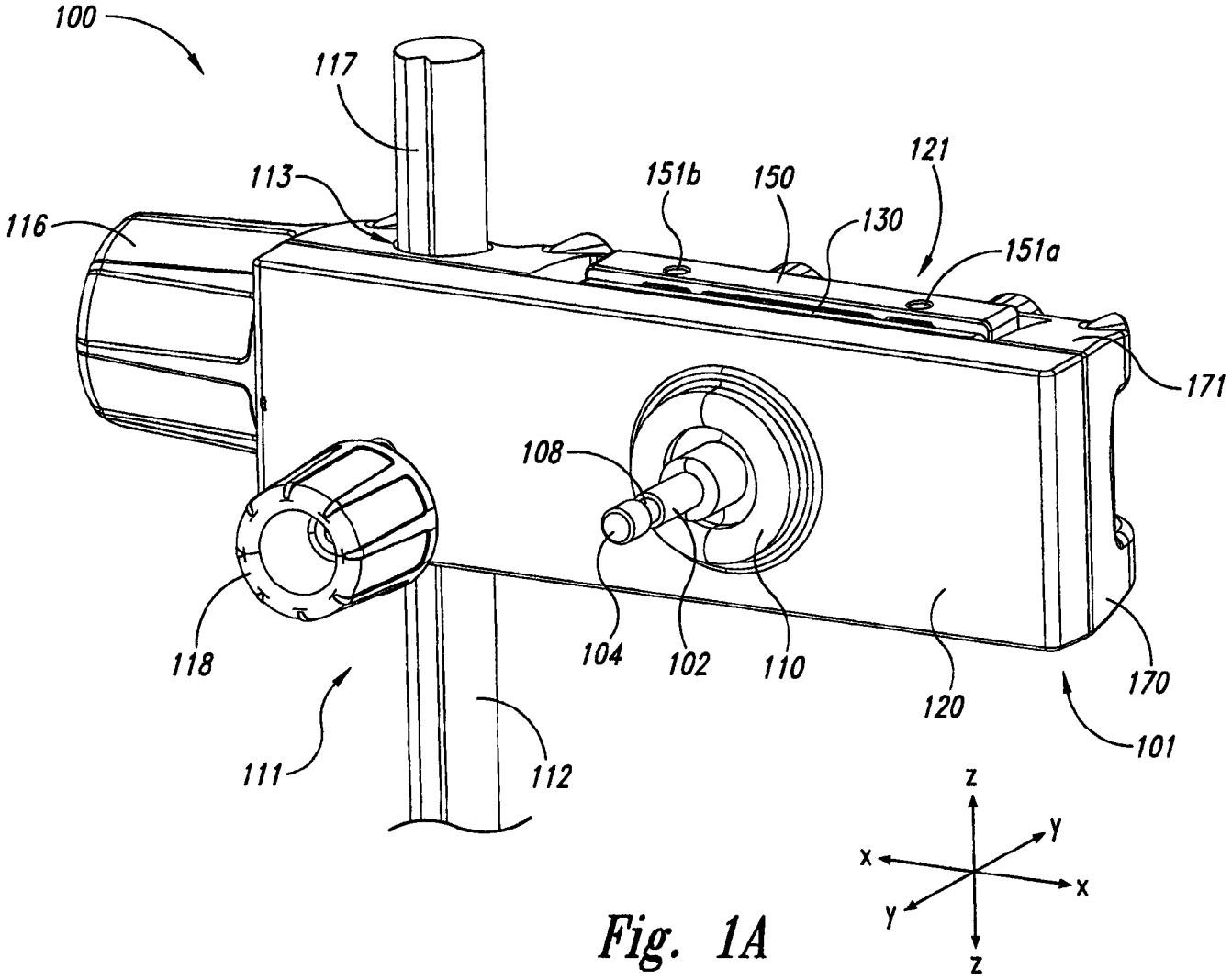
FIG. 1A is a rear isometric view.

The following disclosure describes several embodiments of adjustable firearm supports and rests. In one embodiment, a shooting rest includes a rest assembly for supporting a forestock of a firearm. The rest assembly includes a base member and first and second upright members extending from the base member. A position of each of the first and second upright members is independently adjustable with reference to the base member. The shooting rest also includes a support assembly coupled to the rest assembly to move the rest assembly in a first direction and in a second direction. The first and second directions are in a plane generally transverse to a longitudinal axis of the firearm. The shooting rest further includes a base coupled to the support assembly.

In another embodiment, a shooting rest includes a housing including a housing body, a housing cover, and a cavity therebetween. The shooting rest also includes a support assembly at least partially contained within the cavity, wherein the support assembly includes a first plate and a second plate. The shooting rest further includes a rest assembly for supporting a forestock of a firearm, wherein the rest assembly is removably attached to the second plate. The shooting rest also includes a shaft having a first end portion projecting from the housing cover, a mid portion coupled to the second plate, and a second end portion coupled to the housing body. The support assembly is configured to move the rest assembly in any direction in a plane generally transverse to a longitudinal axis of the firearm in response to a movement of the shaft. The shooting rest also includes a non-planar base coupled to the housing.

In another embodiment, a shooting rest includes a rest assembly for receiving a forestock of a firearm having a longitudinal axis. The rest assembly includes a base member and first and second movable upright members extending from the base member. The shooting rest further includes a support assembly coupled to the rest assembly, wherein the support assembly is configured to simultaneously move the rest assembly in a first direction generally transverse to the longitudinal axis and in a second direction generally transverse to the longitudinal axis and to the first direction. The support assembly is configured with an adjustable force required to move the adjustable rest with the support assembly in the first and second directions, thus allowing the weight of the gun to be supported in the static position.

In another embodiment, a shooting rest includes a front support for supporting a forestock of a firearm. The front support includes a rest assembly having first and second independently adjustable upright members, and a support assembly coupled to the rest assembly. The support assembly is configured to move the rest assembly in any direction in a plane generally transverse to a longitudinal axis of the firearm. The shooting rest further includes a rear support for supporting a buttstock of the firearm, and a frame coupled to the front support and the rear supports. According to one embodiment, the front support is configured in a fixed position and the rear support is configured to be moveable.

In another embodiment, a shooting rest includes a front support for carrying a forestock of a firearm. The front support is configured to adjust a position of the forestock in a first direction generally transverse to a longitudinal axis of the firearm and in a second direction generally transverse to the longitudinal axis, wherein the first and second directions are generally transverse to each other. The shooting rest further includes a rear support for carrying a buttstock of the firearm. The rear support includes an inhibiting member for at least partially inhibiting a rearward movement of the firearm relative to the shooting rest. The shooting rest also includes a frame connected to at least one of the front and rear supports.

Another embodiment of the invention includes a method of forming a shooting rest configured for supporting a firearm. The method comprises attaching a first upright member to a support plate with a first connector and attaching a second upright member to the support plate with a second connector. The first and second connectors extend through corresponding slots in the support plate to provide an adjustability of each of the first and second upright members along the corresponding slots. The method further comprises removably coupling the support plate to a support assembly having first and second slide plates slidably engaged with a housing. The second slide plate is attached to the support plate, and the support assembly is configured to move the support plate in a plane generally transverse to a longitudinal axis of the firearm. The method further comprises removably coupling the support assembly to an elevation assembly and coupling the elevation assembly to a base.

Specific details of several embodiments are described below with reference to shooting supports, rests, and assemblies. Several details describing well-known structures or processes often associated with shooting supports, rests, and assemblies are not set forth in the following descriptions for purposes of brevity and clarity. Also, several other embodiments may have different configurations, components, or procedures than those described in this section. A person of ordinary skill in the art, therefore, will understand that the invention may have other embodiments with additional elements, or that the invention may have other embodiments without several of the elements shown and described below with reference to FIGS. 1A-15.

In the Figures, like reference numbers refer to like elements, or generally similar elements. To facilitate the discussion of any particular element, the most significant digit or digits of any reference number refer to the Figure in which that element is first introduced. For example, element 310 is first introduced and discussed with reference to FIG. 3. Furthermore, the Figures described in this section include a three-dimensional reference coordinate system (e.g., x-, y- and z-directions) to aid in the explanation of certain features of the embodiments described herein.

B. Embodiments of Shooting Rests

Figure 1B:
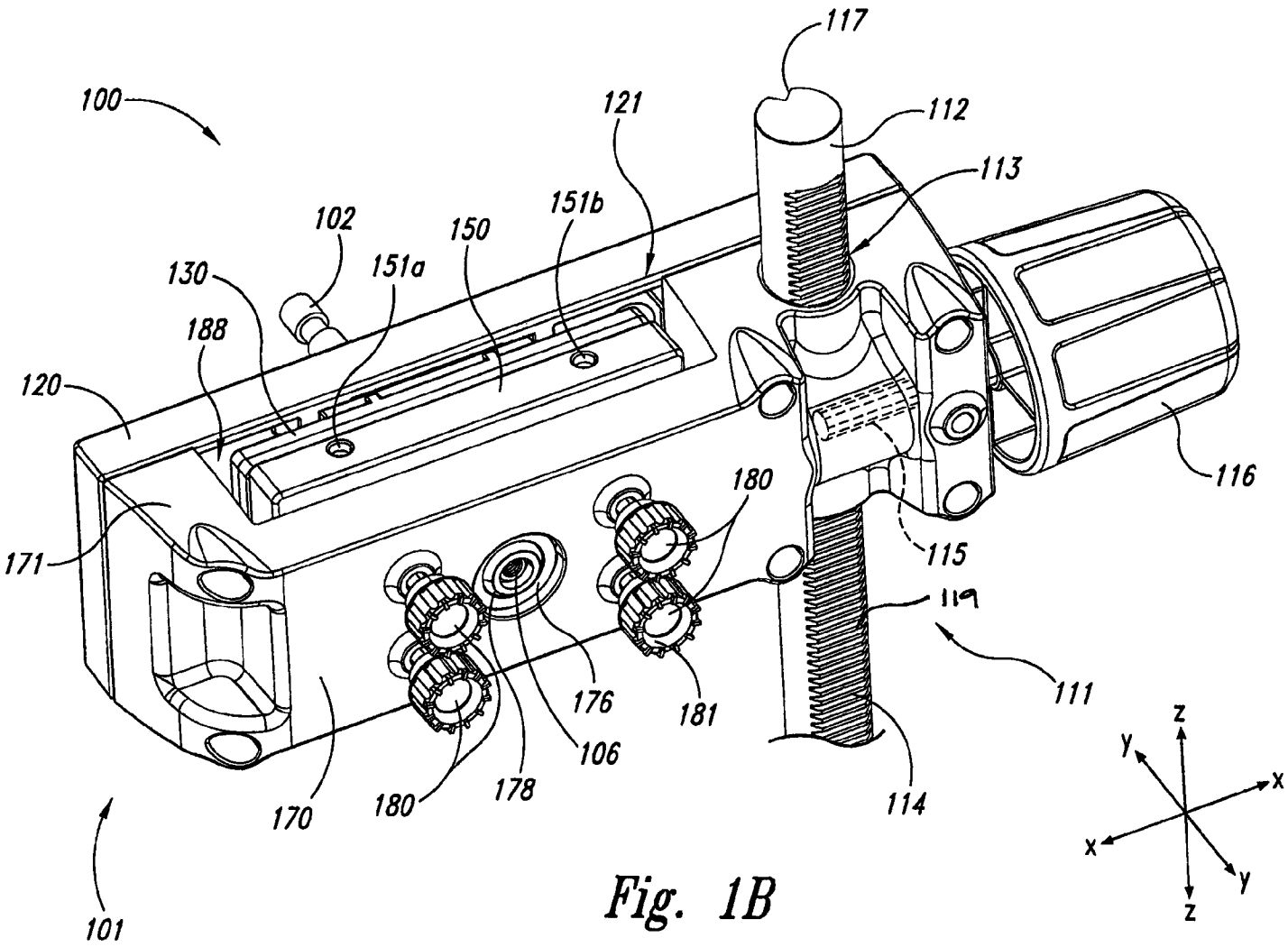
FIG. 1B is a front isometric view.
Figure 1C:
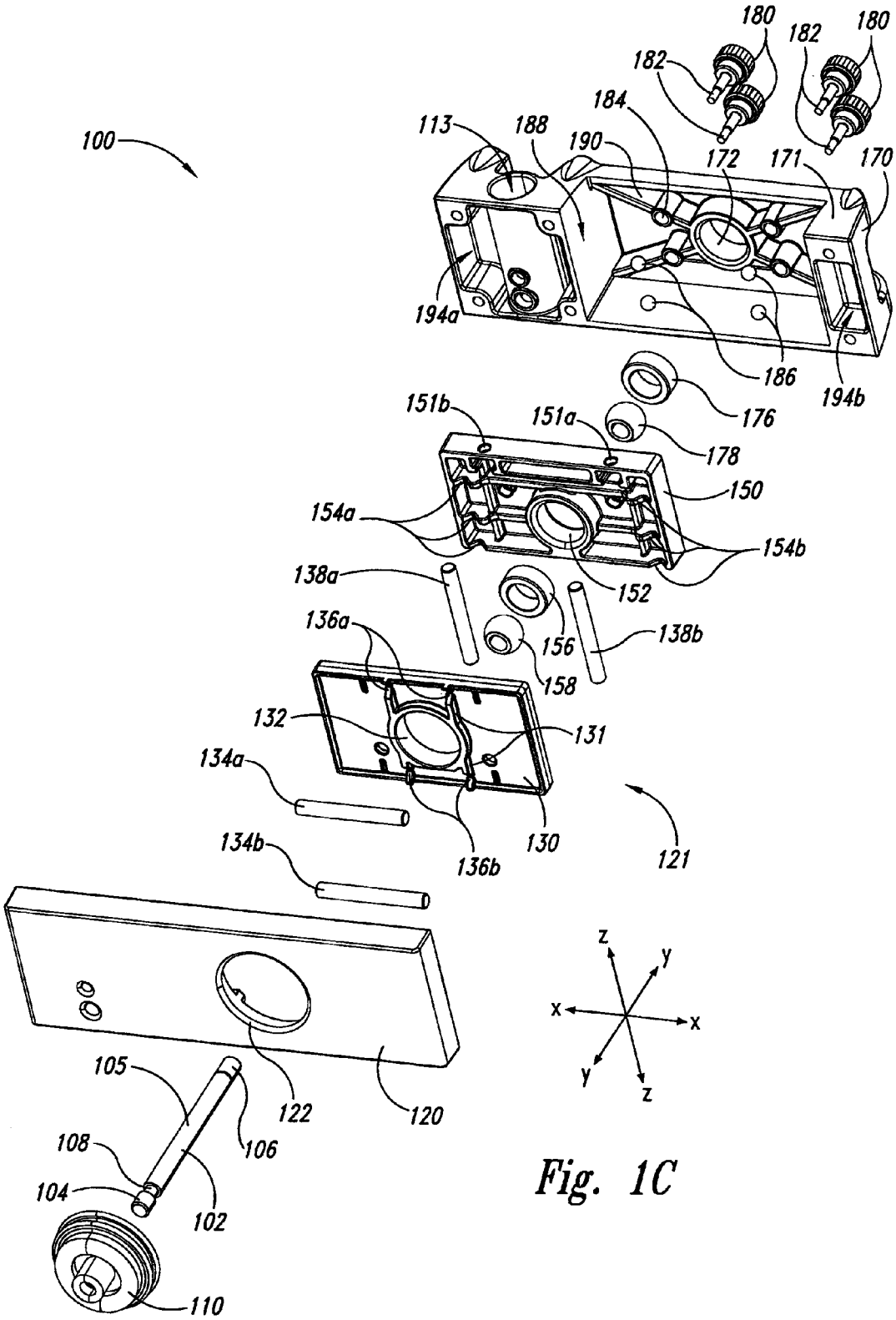
FIG. 1C is an exploded rear isometric view of a portion of a support assembly including a firearm control box configured in accordance with one embodiment of the invention.

FIG. 1A is a rear isometric view, FIG. 1B is a front isometric view, and FIG. 1C is a partial, exploded isometric view of a support assembly 100 configured in accordance with one embodiment of the invention. For the purposes of illustration, the y-direction indicates a direction generally parallel to a longitudinal axis of a firearm (not shown) supported in the support assembly 100. Referring to FIGS. 1A-1C together, the support assembly 100 includes a housing 101 coupled to a gross adjustment assembly 111 and a fine adjustment assembly 121. The gross adjustment assembly 111 provides rapid movement of the housing 101 in the z-direction, and the fine adjustment assembly 121 may provide a more controlled and limited movement of a firearm rest or attached accessory in the x-direction, z-direction, and/or x- and z-directions simultaneously.

As illustrated in FIGS. 1A and 1B, the gross adjustment assembly 111 includes a longitudinal member 112, an actuator 116, and a locking element 118. The actuator 116 and locking element 118 in FIGS. 1A-1B are shown in a dial configuration, however, as can be appreciated by one skilled in the art, a variety of mechanical devices such as levers, knobs, cam locks of other actuator configurations may be used and remain within the spirit of the invention. In one aspect of this embodiment, the longitudinal member 112 may have a generally cylindrical shape and extend through an offset opening 113 in the housing 101. The longitudinal member 112 in FIGS. 1A-1B has a generally circular cross-sectional geometry at a plane transverse to its longitudinal axis (i.e., the x-y plane). In other embodiments, however, the longitudinal member 112 may include other suitable geometries and configurations (e.g., rectangular or polygonal shapes). A plurality of threads 114 may be formed in a side portion of the longitudinal member 112 to form a rack gear 119 integral with the longitudinal member 112. A pinion gear 115 (shown in broken lines in FIG. 1B) is coupled to the actuator 116 and is configured to engage the rack gear 119 in operation. The actuator 116 is configured to engage the housing 101 such that rotation of the pinion gear 115 moves the housing 101 along the longitudinal member 112 in the z-direction. Alternatively the gross adjustment mechanism 111 may be another mechanical actuator mechanism such as a hydraulic jade system, a dovetail post and channel, or other actuator mechanisms as is known in the art.

In the embodiment illustrated in FIGS. 1A and 1B, the longitudinal member 112 also includes an alignment channel 117 extending the length of the longitudinal member 112. The channel 117 may align the housing 101 with respect to the longitudinal member 112. In the illustrated embodiment, the channel 117 is positioned generally opposite the threads 114 and has a V-shaped geometry within a periphery of the longitudinal member 112. The locking element 118 is configured to engage the housing 101 and to prevent movement when the locking element 118 is in the locked position. For example, moving the locking element 118 into the locked position may include moving an engagement member (not shown for clarity) into the channel 117, thus at least partially secure the housing 101 at a desired elevation along the longitudinal member 112. In other embodiments, other means (e.g., threaded and locking bushings positioned around the longitudinal member 112) may be used to adjust and secure the position of the housing 101 along the longitudinal member 112.

One feature of the illustrated embodiment of the gross adjustment assembly 111 is that its components may provide several manufacturing benefits. For example, a longitudinal member 112 with a circular profile may reduce manufacturing costs and may further improve tolerances in the gross adjustment assembly 111. Manufacturing costs are reduced because the upright opening 113 may be formed by boring or reaming a round through-hole through the housing 101, rather than machining a rectilinear slot. In other embodiments, the upright opening 113 may also be formed in a molding process. In addition, the longitudinal member 112 may also be formed from round "off-the-shelf" bar stock having highly accurate tolerances, rather than custom machining a conventional rectangular upright member. Moreover, forming the threads 114 and channel 117 within the cross-sectional profile of the longitudinal member 112 may eliminate additional processing steps required to attach threads or alignment features to the longitudinal member 112.

While the gross adjustment assembly 111 moves the housing 101 in the z-direction, the fine adjustment assembly 121 provides more precise and controlled movement of attached accessories in the x-z plane. Referring to FIGS. 1A-1C, the fine adjustment assembly 121 includes a number of components generally enclosed within the housing 101. For example, the housing 101 includes a housing cover 120 and a housing body 170 enclosing a first slide plate 130 and a second slide plate 150 in a cavity 188. The housing cover 120 includes an opening 122 having a diameter configured to allow radial movement of an adjustment shaft 102. The shaft 102 includes a first end portion 104, a locking channel 108, a mid portion 105, and a second end portion 106. The second end portion 106 is coupled to the housing body 170, and the mid portion 105 extends through the support assembly 100 such that the first end portion 104 projects from the housing cover 120. The locking channel 108 enables a control arm or other device to be removably attached to the shaft 102 (see, e.g., FIG. 4A). A flexible seal 110 covers the opening 122 in the housing cover 120 and a portion of the shaft 102. The seal 110 prevents particulate matter, water or other contaminants from entering the cavity 188 through the opening 122 in the housing cover 120. In certain embodiments, the seal 110 may be made of a resilient material (e.g., rubber) to accommodate movement of the shaft 102.

The first slide plate 130 is positioned proximate to an interior side of the housing cover 120 and includes an opening 132 generally aligned with the opening 122 in the housing cover 120. In certain embodiments, the opening 132 in the first slide plate 130 may have a smaller diameter than the opening 122 in the housing cover 120. In other embodiments, however, the opening 132 in the first slide plate 130 may be equal to or greater than the opening 122 in the housing cover 120. In one aspect of this embodiment, a first set of pins 134 (identified individually as first and second pins 134*a*, 134*b*) is positioned between the first slide plate 130 and the housing cover 120. The first pins 134 are spaced apart and generally oriented in the x-direction. The first pins 134 may be composed of steel or other durable materials suitable for sliding contact with the first slide plate 130. Corresponding channels 136 (identified individually as first and second channels 136*a*, 136*b*) retain the first pins 134 between the first slide plate 130 and corresponding channels (not shown) in the housing cover 120. In certain embodiments, the channels 136 may be formed in stiffening ribs 131 in the first slide plate 130. The first pins 134 remain generally stationary with reference to the housing cover 120 as the fine adjustment assembly 121 moves, and the first slide plate 130 may accordingly slide along the first pins 134 in the x-direction.

In certain embodiments, the first slide plate 130 is composed of a metal suitable for die casting, molding, or similar manufacturing processes. For example, the first slide plate 130 may be made of aluminum, zinc, copper, alloys of these, or other metals. In other embodiments, however, the first slide plate 130 may be composed of other suitable materials, such as plastics or thermosets. The first slide plate 130 may accordingly accommodate a sliding motion with reference to the first pins 134 and provide suitable wear resistance therebetween.

The fine adjustment assembly 121 also includes a second set of pins 138 (identified individually as first and second pins 138*a*, 138*b*) positioned between the first slide plate 130 and the second slide plate 150. The second pins 138 are spaced apart and generally oriented in the z-direction (i.e., in a direction generally transverse to the first set of pins 134). The second pins 138 are retained in corresponding channels 154 (identified individually as first and second channels 154*a*, 154*b*) in the second slide plate 150. The second pins 138 are also seated in corresponding channels (not shown) in a side of the first slide plate 130 facing the second slide plate 150. The second pins 138 slide against the first plate in the z-direction and remain generally stationary with reference to the second slide plate 150, as the fine adjustment assembly 121 moves. Accordingly, the second pins 138 slide together with the second slide plate 150 against the first slide plate 130 in the z-direction. As shown in the illustrative embodiment, the first pins 134 and the second pins 138 have a circular cross-section, however, as can be appreciated by one skilled in the art, the pins may alternatively have a hexagonal or other geometric cross-section.

In certain embodiments, the second slide plate 150, as well as the housing cover 120 and housing body 170, may be composed of a thermosetting plastic material, such as a thermoset. In other embodiments, these components may be composed of a metal material. These components may accordingly have suitable molding geometries and be formed in a molding process, such as an injection or compression molding process, to provide durable components at a reduced cost and weight. According to one feature of this embodiment, these components may include a plurality of ribs or stiffeners to provide structural stability at a reduced weight. For example, the housing body 170 may accordingly include a plurality of recesses 194 (identified individually as first and second recesses 194*a*, 194*b*) and ribs 190. The illustrated first and second slide plates 130, 150 may also include a plurality of stiffening ribs (e.g., ribs 131 on the first slide plate 130). Forming these components in a casting or molded process may also save manufacturing time and cost, as each component may not have to be individually machined. This differs from conventional firearm rest components that are machined from solid metal materials.

The second slide plate 150 also includes an opening 152 configured to receive a first bushing 156 and a first spherical bearing 158. In certain embodiments, the first bushing 156 may be press-fit into the opening 152. In other embodiments, however, the first bushing 156 may be adhered to or otherwise attached to the opening 152. The first spherical bearing 158 is inserted in the first bushing 156 and is concentric therewith to rotate within the first bushing 156. The first spherical bearing 158 also includes an opening corresponding to a diameter of the shaft 102 so that the mid portion 105 of the shaft 102 may pass through the first spherical bearing 158. As explained below, the shaft 102 is inserted through the first spherical bearing 158 to move the second slide plate 150 in various directions in the x-z plane. The second slide plate 150 also includes a one or more attachment sites 151 (identified individually as first and second attachment sites 151*a*, 151*b*) to removably attach a firearm rest or other accessory to the second slide plate 150.

The second slide plate 150 also includes a generally planar side (not shown) facing the housing body 170 to contact a plurality of ball bearings 186 in the housing body 170. The planar side of the second slide plate 150 may accordingly move in any direction in the x-z plane against the ball bearings 186. Individual ball bearings 186 may be positioned in corresponding openings 184 in the housing body 170 and protrude toward the second slide plate 150. Spring-loaded plungers 182, or similar mechanisms, coupled to corresponding compression dials 180, may be inserted through the openings 184. The compression dials 180 are threadably engaged with the housing body 170, and may be adjusted to exert a force on corresponding ball bearings 186 and the second slide plate 150.

The housing body 170 also includes an opening 172 configured to receive a second bushing 176 and a concentric second spherical bearing 178, generally similar to first bushing 156 and first spherical bearing 158. The second end portion 106 of the shaft 102 is inserted into the second spherical bearing 178 and may be removably attached thereto. The second spherical bearing 178 may accordingly act as a pivot point of the shaft 102 at the second end portion 106. In certain embodiments, the first and second bushings 156, 176 may be omitted such that the first and second spherical bearings 158, 178 are inserted directly into the second slide plate 150 and the second housing body 170, respectively.

In one aspect of the embodiment illustrated in FIGS. 1A-1C, the shaft 102 is configured to move the second slide plate 150 in any direction in the x-z plane (i.e., generally transverse the y-direction). Moving in any direction in the x-z plane is achieved by a combination of movements in the x and z directions. More specifically, when radially moving the shaft 102, the first spherical bearing 158 may rotate in the first bushing 156 in the second slide plate 150 to allow the shaft 102 to pivot about the second spherical bearing 178. This configuration allows the second slide plate 150 to remain generally parallel to the x-z plane and also simultaneously move in the x and z directions. Moving the shaft 102 in the z-direction moves the second slide plate 150 together with the second set of pins 138 against the first slide plate 130. Moving the shaft 102 in the x-direction, however, moves the second slide plate 150, the second set of pins 138, and the first slide plate 130 as a group against the first set of pins 134. The configuration of the fine adjustment assembly 121 provides precise and controlled movement of the second slide plate 150, and attached accessories, in any direction in the x-z plane within the range of motion of the fine adjustment assembly 121.

In certain embodiments, a sensitivity of the fine adjustment assembly 121 may be adjusted. For example, each compression dial 180 threadably engaged with the housing body 170 may rotate to move the corresponding plungers 182 toward or away from the second slide plate 150. Each plunger 182 exerts a force against the corresponding ball bearing 186, which in turn exerts a force against the planar surface of the second slide plate 150. Accordingly, rotating a compression dial 180 may alter a compressive force of the second slide plate 150 against the first slide plate 130 and housing cover 120 and corresponding sets of pins 134, 138, to alter the force required to move the slide plates 130, 150. In one aspect of this embodiment, each of the compression dials 180 may include a reference indicator 181 to show a position or setting of the corresponding dial 180. The reference indicator 181 may include, for example, a number or other reference marking to allow for repeatable adjustment settings. As a result, the compression dials 180 provide a way for a shooter to adjust the sensitivity of the fine adjustment assembly 121 without the use of a separate tool (e.g., a screwdriver, Allen wrench, etc.). Moreover, the reference indicator 181 may also allow a shooter to repeat sensitivity adjustments corresponding to different firearms. In an alternative embodiment, the compression force between the plates may be easily adjusted to allow static support of varying weight items being support or attached accessory.

Figure 2A:
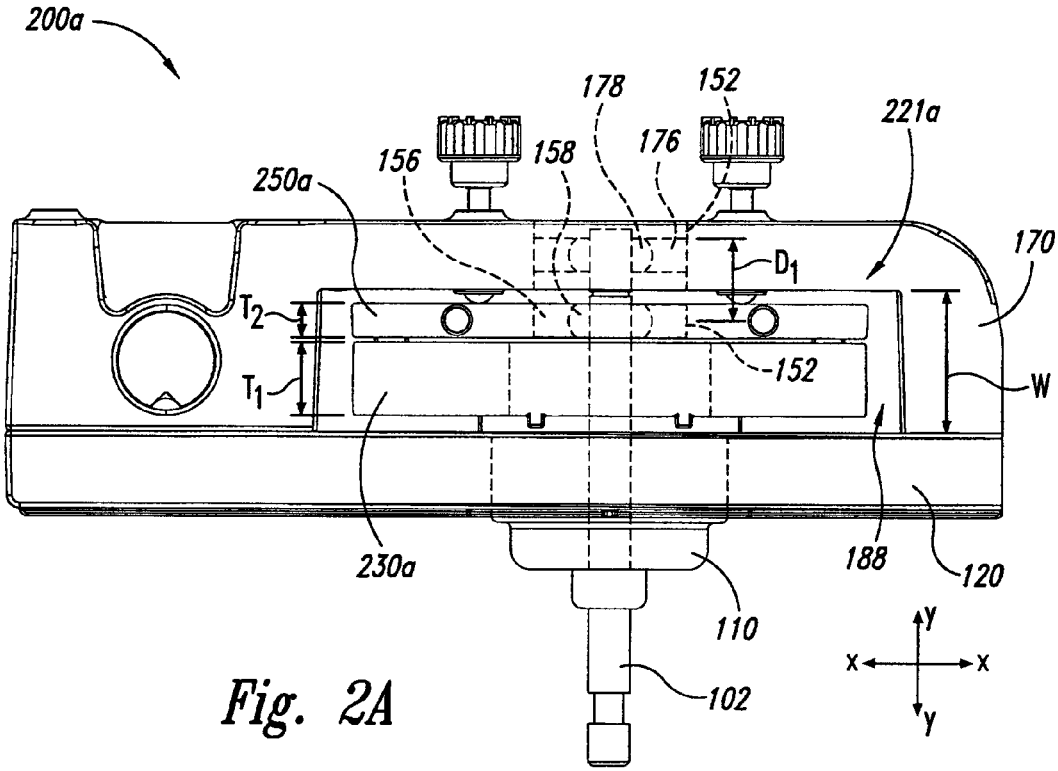
FIGS. 2A-2C are top views and FIG. 2D is an exploded rear isometric view of support assemblies configured in accordance with additional embodiments of the invention.

In certain embodiments, the sensitivity of the fine adjustment assembly 121 may be also adjusted by changing the distance between the first spherical bearing 158 and the second spherical bearing 178. For example, the greater the distance between the spherical bearings 158, 178, the greater the range of movement of the second slide plate 150. Accordingly, FIGS. 2A-2D illustrate different support assemblies 200*a*-200*d*, respectively, each having various configurations of fine adjustment assemblies 221*a*-221*d*. FIG. 2A, more specifically, is a top view of the support assembly 200*a* including the fine adjustment assembly 221*a*. The fine adjustment assembly 221*a* is generally similar to the embodiment illustrated in FIGS. 1A-1C; however in this embodiment the fine adjustment assembly 221*a* includes a first slide plate 230*a* having a first thickness $T_1$, and a second slide plate 250*a* having a second thickness $T_2$ that is less than the first thickness $T_1$. In one aspect of this embodiment, the cavity 188 is configured to have a width W to accommodate the combined thicknesses $T_1$ and $T_2$ of the first and second slide plates 230*a*, 250*a*.

The relatively thin second thickness $T_2$ of the second slide plate 250*a* positions the first bushing 156 and accordingly the first spherical bearing 158 at a first distance $D_1$ from the second bushing 176 and the second spherical bearing 178. The closer the first and second spherical bearings 158, 178 are to one another, the less the second slide plate 250*a* will move in the x-z plane in response to movement of the shaft 102.

Figure 2B:
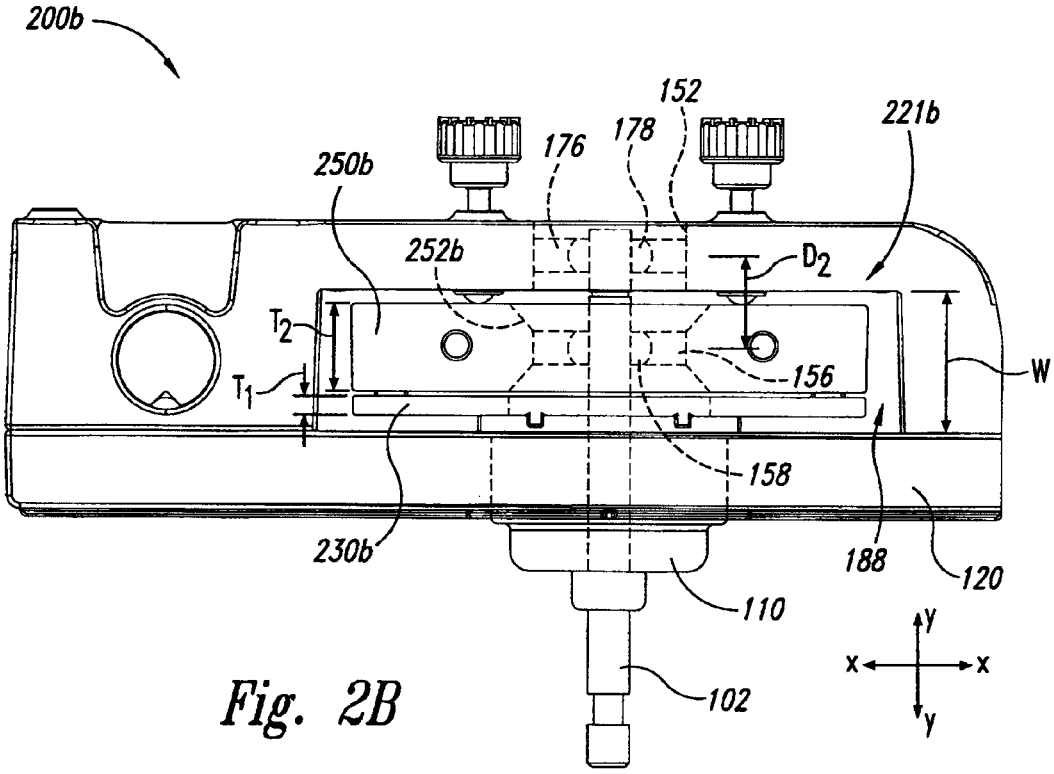

FIG. 2B is a top view of the support assembly 200*b* including the fine adjustment assembly 221*b*. The fine adjustment assembly 221*b* is generally similar to the fine adjustment assembly 221*a* illustrated in FIG. 2A; however, in the illustrated embodiment, a first slide plate 230*b* has a first thickness $T_1$ that is less than a second thickness $T_2$ of a second slide plate 250*b*. In one aspect of this embodiment, the second slide plate 250*b* may include an opening 252*b* configured to accommodate the radial movement of the shaft 102 through the thicker second slide plate 250*b*. The relatively thick second slide plate 250*b* positions the first spherical bearing 158 in the second slide plate 250*b* at a second distance $D_2$ (greater than the first distance $D_1$ illustrated in FIG. 2A) from the second spherical bearing 178. Accordingly, with the configuration illustrated in FIG. 2B, the second slide plate 250*b* will move a greater distance in the x-z plane in response to movement from the shaft 102.

In one aspect of the embodiments illustrated in FIGS. 2A and 2B, the first and second slide plates 230*a*, 250*a* of FIG. 2A may be interchangeable with the first and second slide plates 230*b*, 250*b* of FIG. 2B. Accordingly, a support assembly 200 may be sold with both sets of slide plates 230, 250 and a shooter may change the plates according to the shooter's sensitivity preference.

Figure 2C:
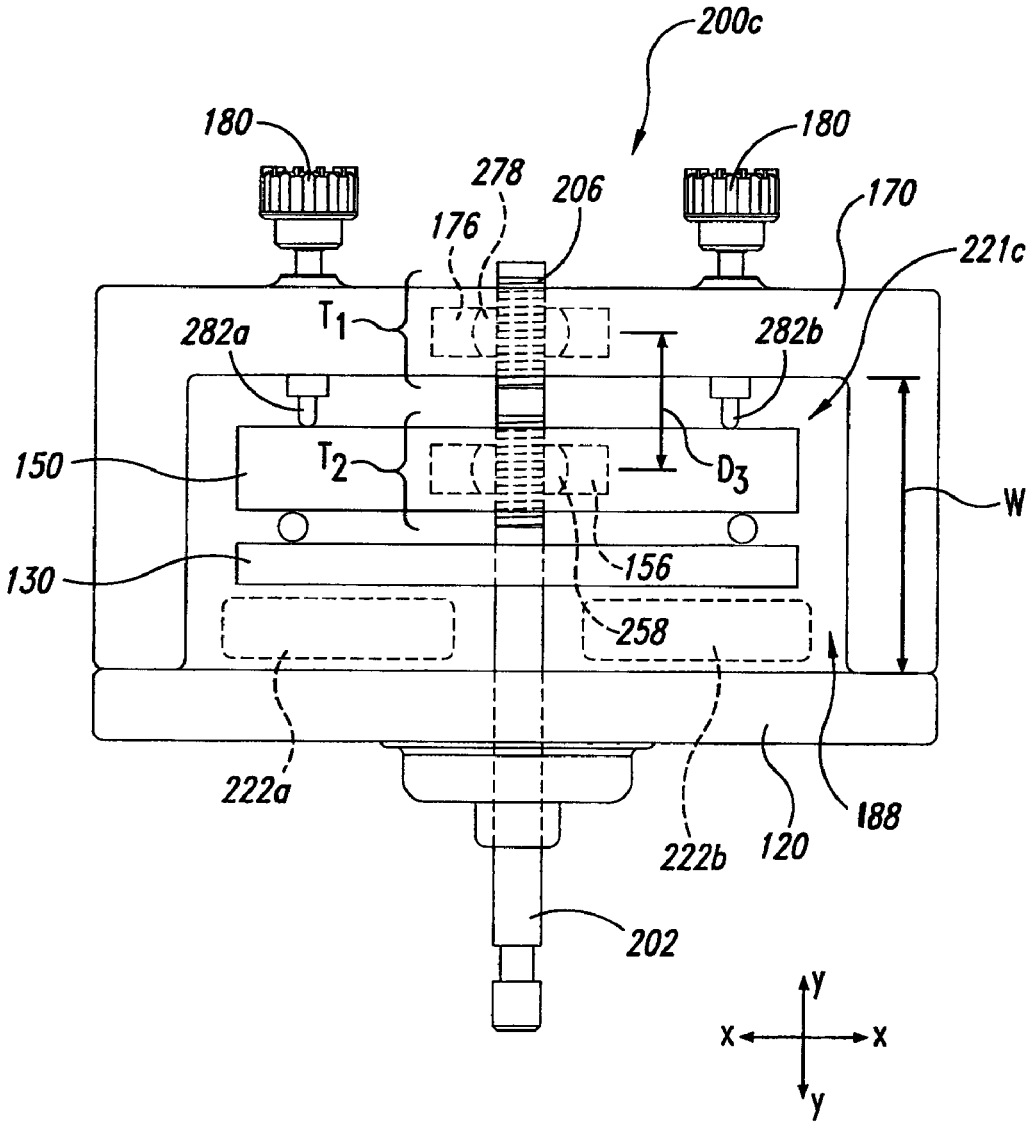

FIG. 2C is a top view of the support assembly 200*c* with the fine adjustment assembly 221*c* configured in accordance with another embodiment of the invention. The fine adjustment assembly 221*c* is generally similar to the embodiments described above; however, in this embodiment a shaft 202 is configured to move in the y-direction to change an adjustable distance $D_3$ of a first spherical bearing 258 from a second spherical bearing 278. In one aspect of this embodiment, the shaft 202 includes a threaded portion $T_1$ that may be threadably engaged with the second spherical bearing 278. The first spherical bearing 258 may be at a fixed position along the shaft 202 but still rotate within the first bushing 156, such that when the shaft 202 is rotated about its longitudinal axis (i.e., about the y-axis) the first spherical bearing 258 will move in the y-direction away from or toward the second spherical bearing 278. Accordingly, the second slide plate 150 will move with the first spherical bearing 258. The illustrated embodiment may also include a plurality of spring-loaded plungers 282 (individually identified as first and second plungers 282*a*, 282*b*) to contact the planar surface of the second slide plate 150 and keep the second slide plate 150 pressed against the first slide plate 130. In certain embodiments, the fine adjustment assembly 221*c* may also include a plurality of compressible members 222 (individually identified as first and second compressible members 222*a*, 222*b*) to contact the first slide plate 130 and at least partially press the first slide plate 130 against the second slide plate 150. The compressible members 222 may include elastomeric members configured to allow the first slide plate 130 to slide against them. In other embodiments, the compressible members 222 may include a bladder or chamber that is filled with a fluid, such as a gas or liquid.

In another aspect of the embodiment illustrated in FIG. 2C to adjust the distance $D_3$, between the spherical bearings 258, 278, the first threaded portion $T_1$ of the shaft 202 is not threadably engaged with the second spherical bearing 278. Rather, the second spherical bearing 278 is at a fixed position at an end portion 206 of the shaft 202. In this embodiment, the shaft 202 includes a second threaded portion $T_2$ that threadably engages the first spherical bearing 258, such that when the shaft 202 is rotated about the y-axis, the distance $D_3$ between the first and second spherical bearings 258, 278 may be adjusted. In still further embodiments configured to change the distance $D_3$ between the spherical bearings 258, 278, the first and second threaded portions $T_1$ and $T_2$ may not be threadably engaged with the first and second spherical bearings 258, 278, respectively. Rather, the shaft 202 may be attached to the first spherical bearing 258 and pushed or pulled through the second spherical bearing 278 in the y direction to change the distance $D_3$ between the spherical bearings 258, 278 without rotating the shaft 202.

According to certain aspects of the embodiments illustrated in FIG. 2C, the fine adjustment assembly 221*c* is configured to adjust the position of the second slide plate 150 and attached accessories (e.g., shooting rests, scopes, etc.) in the x, y, and z directions. Moreover, adjusting the position of the first spherical bearing 258 relative to the second spherical bearing 278 in the y-direction provides for a sensitivity adjustment of the support assembly 200*c* without requiring the use of a separate tool or disassembling the support assembly 200*c*.

Figure 2D:
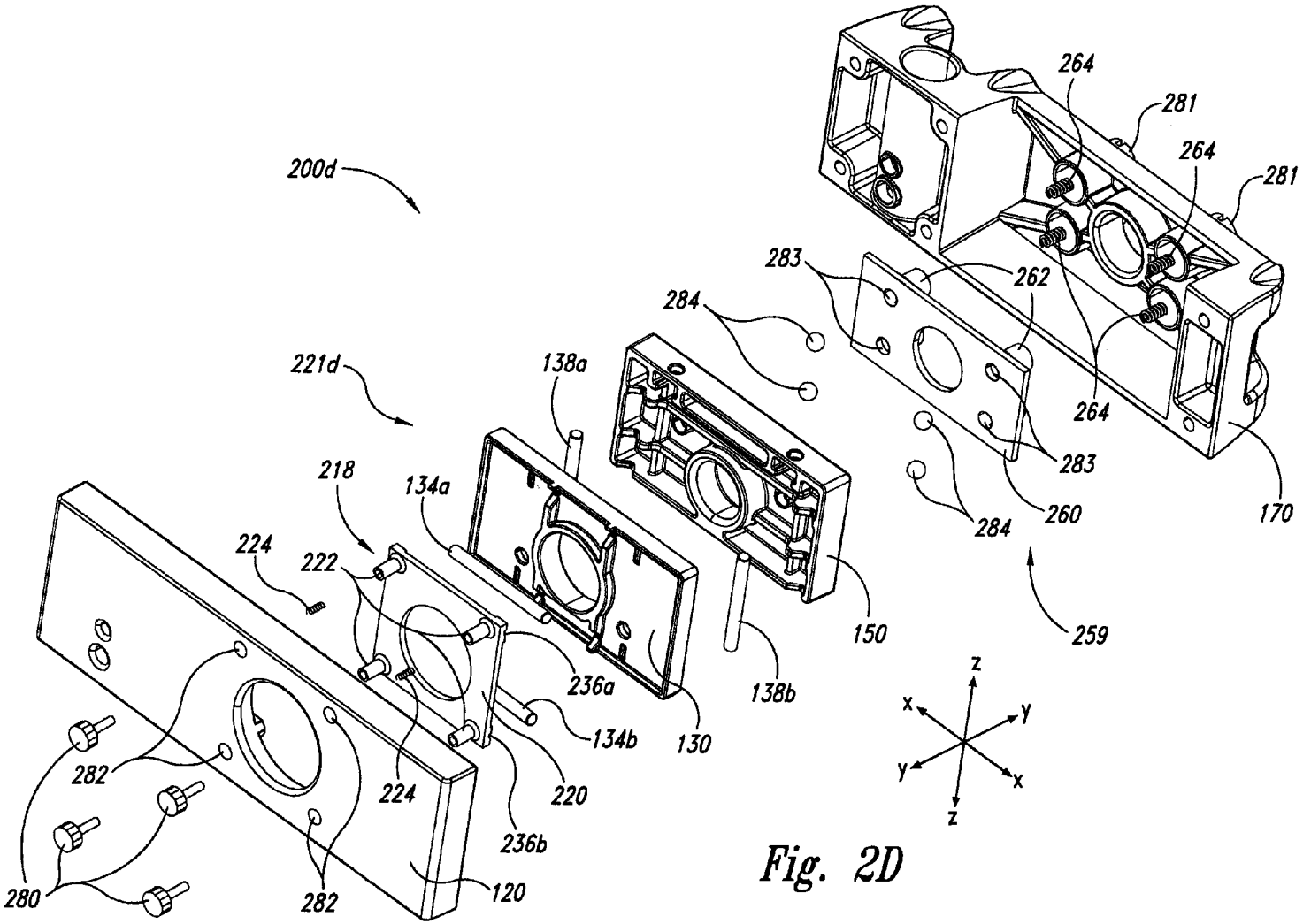

FIG. 2D is an exploded rear isometric view of the support assembly 200*d* having the fine adjustment assembly 221*d* configured in accordance with still another embodiment of the invention. The fine adjustment assembly 221*d* is generally similar to the fine adjustment assembly 121 illustrated in FIG. 1C. In one aspect of the embodiment illustrated in FIG. 2D, however, the fine adjustment assembly 221*d* includes a first compression assembly 218 and a second compression assembly 259 The first and second compression assemblies 218, 258 are configured to at least partially press the first and second slide plates 130, 150 toward each other. Accordingly, the fine adjustment assembly 221*d* may be used in conjunction with the embodiments where the distance between the first and second spherical bearings 158, 178 (not shown in FIG. 2D) is changed as described above with reference to FIGS. 2A-2C. The first compression assembly 218 includes a first support plate 220 positioned between the first slide plate 130 and the housing cover 120. The first support plate 220 includes a plurality of supports 222 projecting from the support plate 220 toward an interior surface of the housing cover 120. The supports 222 may include openings configured to receive biasing members 224 (e.g., springs or spring-loaded members) positioned between the first support plate 220 and the housing cover 120. The first support plate 220 may also include first and second channels 236*a*, 236*b* corresponding to the first set of pins 134. The first slide plate 130 may accordingly move in the x-direction against the first set of pins 134 and the first support plate 220. The first support plate 220 may exert a force in the y-direction against the first slide plate 130 as the second slide plate 150 moves in the y-direction in response to an adjustment of the distance between the first spherical bearing 158 and the second spherical bearing 178.

In one aspect of the illustrated embodiment, the compression assembly 218 may also include front compression dials 280 (shown in broken lines) that may be threadably coupled to openings 282 (also shown in broken lines) in the housing cover 120. The front compression dials 280 may engage the biasing members 224 in the corresponding supports 222. The front compression dials 280 may be configured to be generally similar to the compression dials 180 described above with reference to FIGS. 1B and 1C. For example, the illustrated compression dials may include a reference indicator and provide for tool-less adjustment of the sensitivity of the fine adjustment assembly 221*d*.

The illustrated second compression assembly 259 may be configured to be generally similar to the first compression assembly 218 in order to exert a force in the y-direction against the second slide plate 150. For example, the second compression assembly 259 may include a second support plate 260, a plurality of supports 262, corresponding biasing members 264, and rear compression dials 281. The biasing members 264 may exert a selective force against corresponding ball bearings 284 though openings 283 in the second support plate 260.

Figure 3:
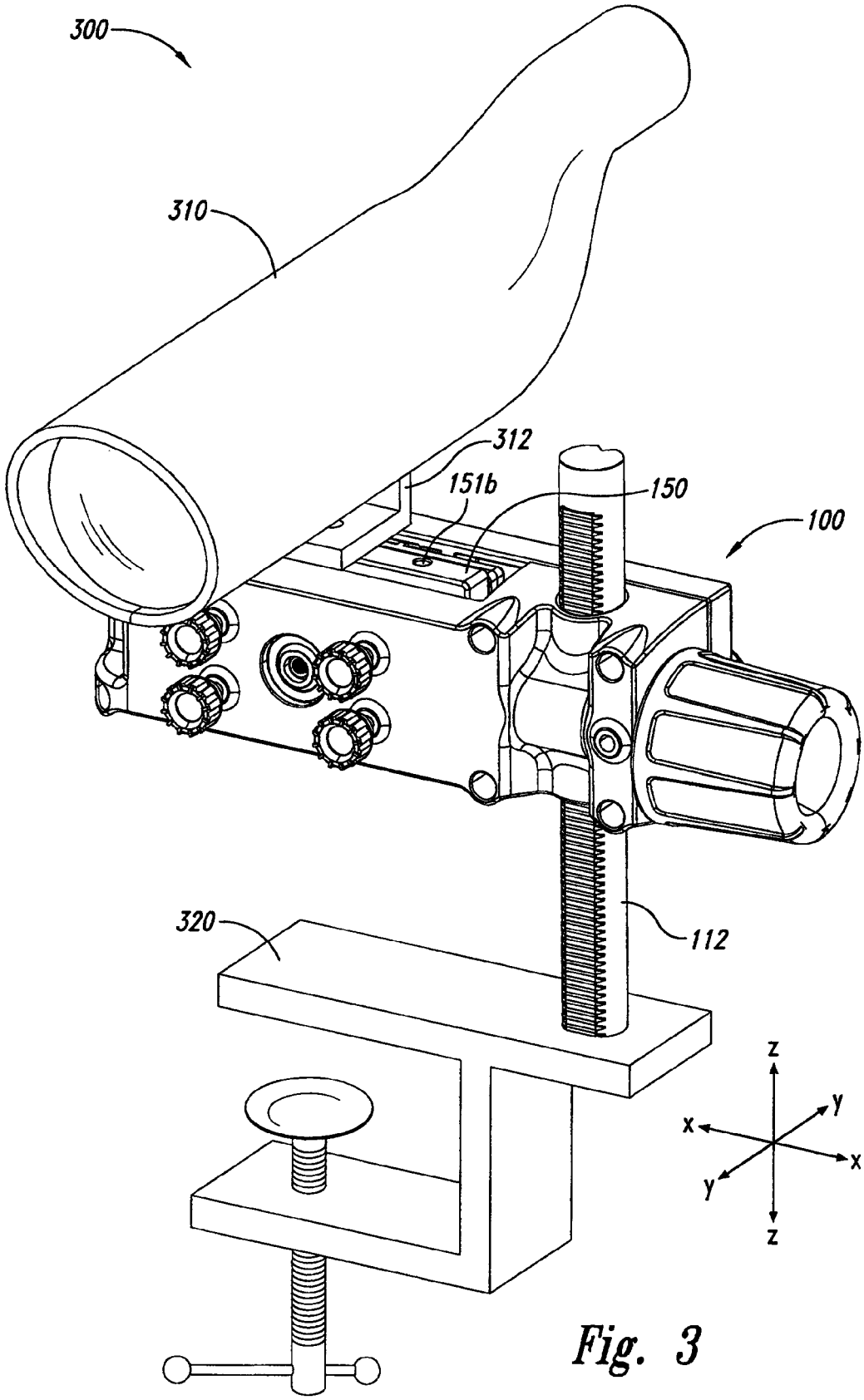
FIG. 3 is a front isometric view of a support assembly coupled to a shooting accessory configured in accordance with an embodiment of the invention.

The various embodiments of the support assemblies 100, 200*a*-200*d* described above with reference to FIGS. 1A-2D may be used with different firearm rests and accessories. FIG. 3, for example, is a front isometric view of a shooting assembly 300 including the firearm support assembly 100 of FIGS. 1A-1C attached to a spotting scope 310. One skilled in the art will appreciate that the spotting scope 310 is merely illustrative of one type of scope or shooting accessory. The scope 310 includes an attachment member 312 aligned with at least one of the attachment sites 151 of the second slide plate 150. The illustrated shooting assembly 300 also includes a clamp device 320 attached to the longitudinal member 112. In certain embodiments, the clamp device 320 may be a C-clamp configured to removably attach the shooting assembly 300 to different structures (e.g., a shooting bench). In other embodiments, however, the clamp device 320 may include other configurations to accommodate removably attaching the shooting assembly 300 to different structures or objects.

Figure 4A:
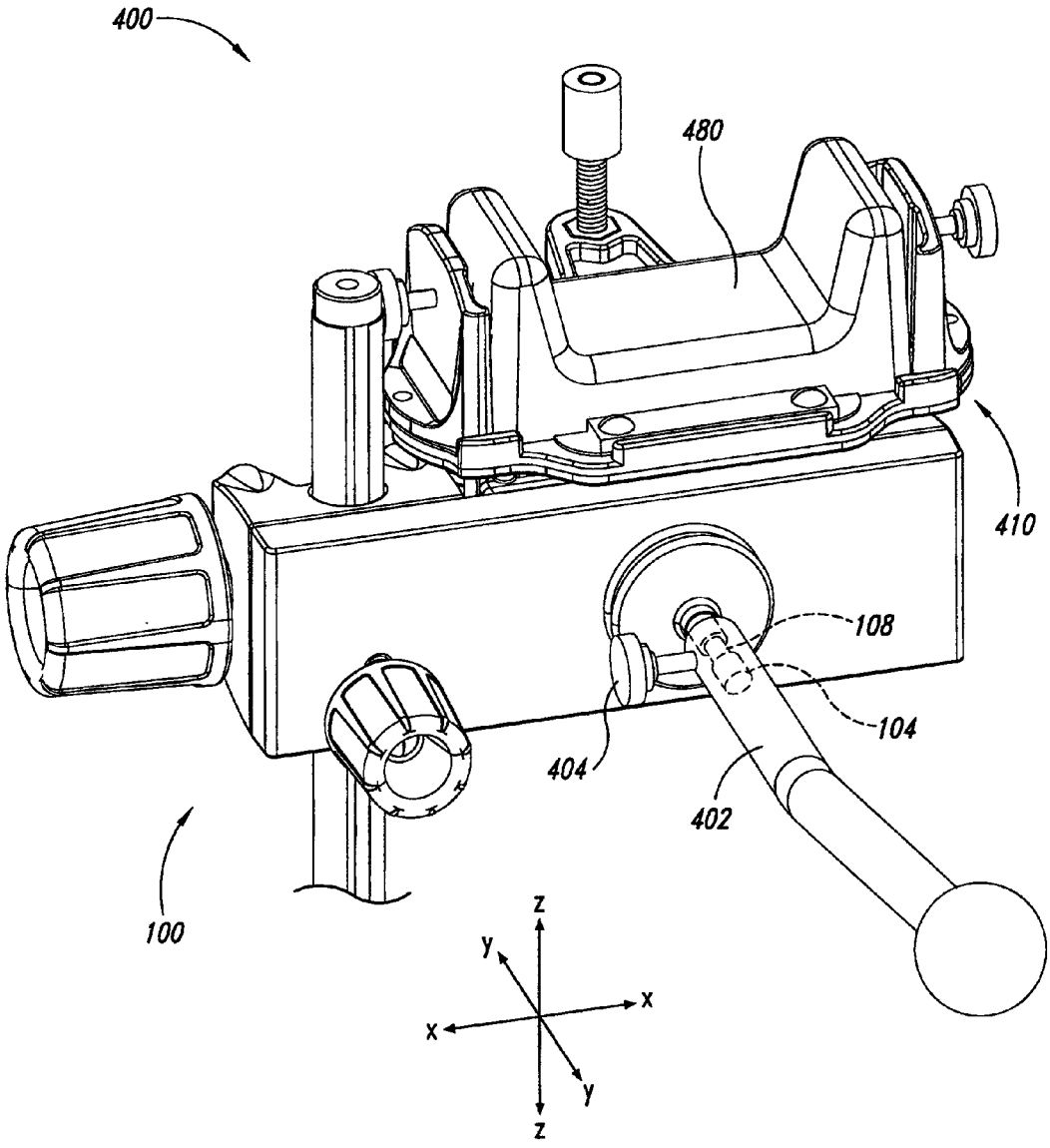
FIG. 4A is a rear isometric view of a support assembly coupled to a rest assembly configured in accordance with another embodiment of the invention.

FIG. 4A is a rear isometric view of a shooting rest 400 configured in accordance with another embodiment of the invention. The rest 400 includes the support assembly 100 described above attached to a firearm rest assembly 410. In the illustrated embodiment, the support assembly 100 includes a control arm or handle 402 attached to the first end portion 104 of the shaft 102 (shown in broken lines). The handle 402 includes an attachment dial 404 to removably engage the handle 402 with the locking channel 108 of the shaft 102. Accordingly, the handle 402 may be attached to or removed from the support assembly 100 without the use of a separate tool. The handle 402 may also have a slightly bent or non-linear configuration to facilitate moving the handle 402 when adjusting the support assembly 100. The illustrated firearm rest assembly 410 is configured to retain a shooting support member 480 (e.g., a shooting bag) that is configured to receive a forestock of a firearm. For example, the shooting support member 480 may have a generally U-shaped configuration and be filled with particulate matter or other suitable materials to provide a stable and firm support surface for a firearm.

Figure 4B:
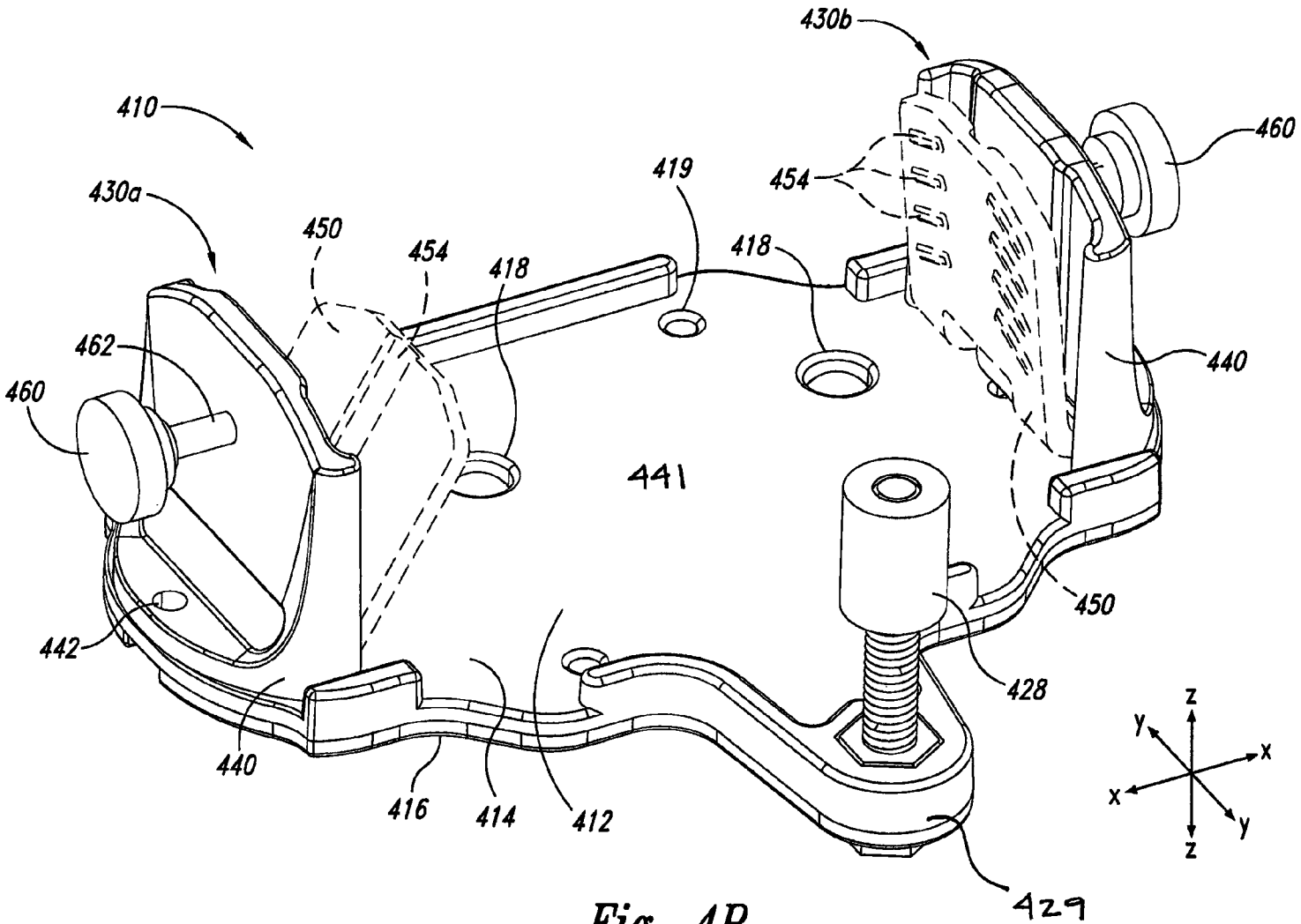
FIG. 4B is an enlarged front isometric view of the rest assembly.
Figure 4C:
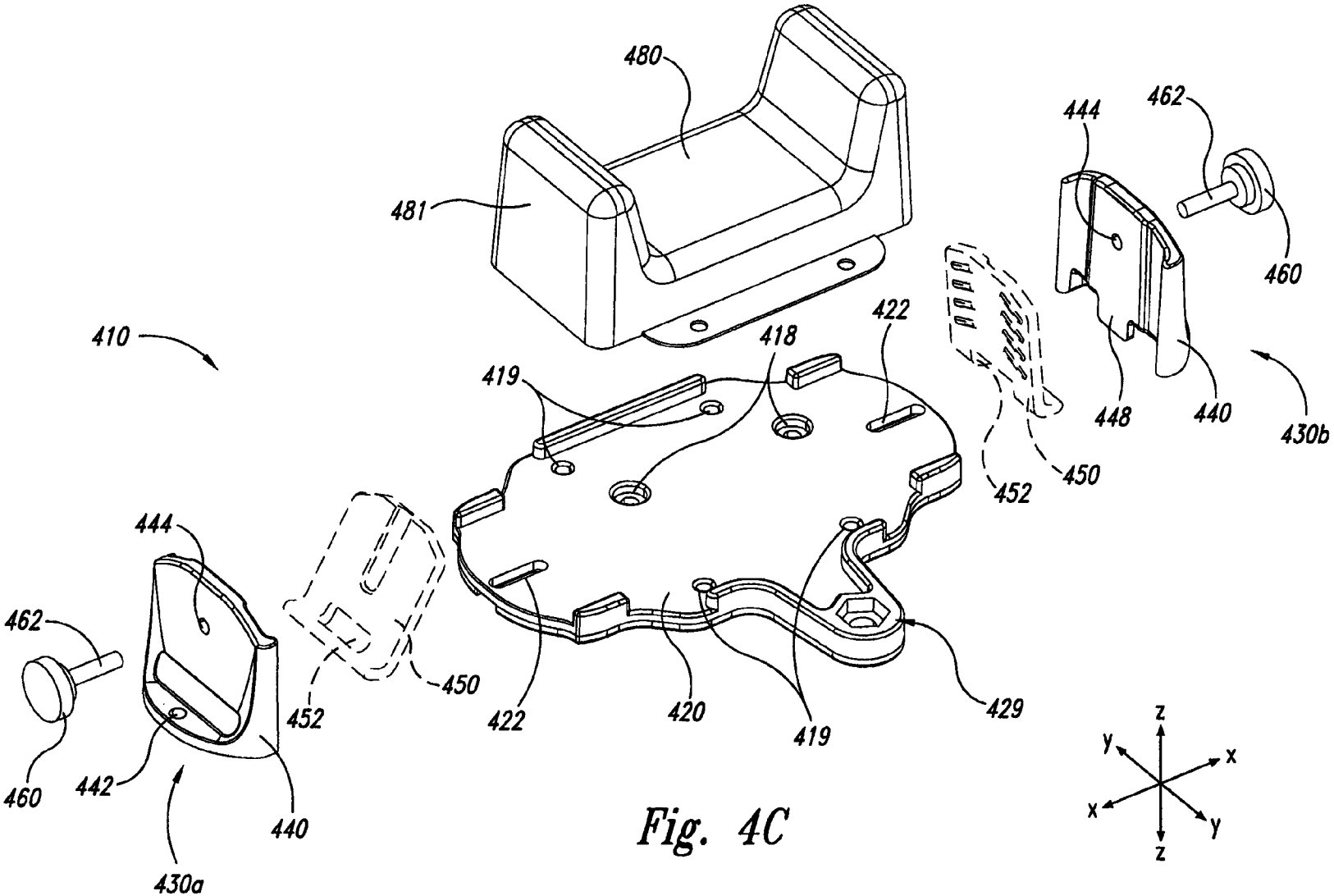
FIG. 4C is an exploded front isometric view of the rest assembly configured in accordance with an embodiment of the invention.

Certain aspects of the rest assembly 410 are illustrated in more detail in FIGS. 4B and 4C. FIG. 4B, more specifically, is an enlarged front isometric view of the rest assembly 410, and FIG. 4C is an exploded front isometric view of the rest assembly 410 and support member 480. Referring to FIGS. 4B and 4C together, the rest assembly 410 includes a support plate 412 having a first side 414 and a second side 416 opposite the first side 414. A plurality of holes 418 extend through the support plate 412 to facilitate attachment to other components. For example, holes 418 align with the attachment sites 151 (not shown in FIGS. 4B and 4C) of the second slide plate 150 of the support assembly 100. The support plate 412 also includes holes 419 to align with corresponding holes 482 in attachment tabs 484 of the support member 480.

The rest assembly 410 also includes retention assemblies 430 (identified individually as first and second retention assemblies 430*a*, 430*b*) to at least partially retain and stabilize the support member 480 on the support plate 412. Each of the retention assemblies 430 includes a sliding member 440 and an optional pivoting member 450 (shown in broken lines) configured to provide different adjustment settings. In one aspect of the illustrated embodiments, each of the sliding members 440 includes a hole 442 to attach a base portion 441 to the first side 414 of the support plate 412. More specifically, a connector (e.g., a screw or bolt) attaches the base portion 441 to the support plate 412 through corresponding slots 422 in the support plate 412. The sliding members 440 may accordingly be independently positioned at various locations in the x-direction on the support plate 412 corresponding to the length of the slots 422. Each sliding member 440 may also include a flange 448 to engage with an opening 452 in corresponding pivoting members 450. The pivoting members 450 may be attached to the sliding members 440 such that the pivoting members 450 may rotate about the flanges 448 to at least partially squeeze the support member 480 positioned between the retention assemblies 430. The pivoting members 450 may also include a plurality of raised features 454 to grip side portions 481 of the support member 480.

In certain embodiments, the retention assemblies 430 include an adjustment dial 460 and a shaft 462 threadably engaged with an opening 444 in each of the sliding members 440. The adjustment dials 460 may be rotated to engage the shaft 462 with the pivoting members 450. The shaft 462 may engage a groove 454 in the pivoting member 450, such that the shaft 462 may slide in the groove 454 as the pivoting member 450 rotates toward the support member 480 to at least partially squeeze and retain the support member 480 in the rest assembly 410.

In certain aspects of the illustrated embodiment, the rest assembly 410 also includes a positioning member 428 coupled to a forward portion 429 of the support plate 412. The positioning member 428 may provide an indication of a position of a barrel of a firearm in the y-direction, such that any deviation of the position of the barrel in the y-direction may be distinguished between shots. Also allows easy reorientation of the gun in the y-axis.

The configuration of the support assembly 100 and the shooting rest 400 illustrated in FIGS. 4A-4C provides many improvements over conventional firearm supports. For example, the configuration of the retention assemblies 430, including the movable sliding members 440 and pivoting members 450, provides the flexibility of enabling shooters to use a variety of different-sized support members 480. Moreover, different-sized support members 480 may be easily removed from or placed in the rest assembly 410. In addition, the adjustment dials 460 enable shooters to alter the retention force against the support member 480 without the use of a separate tool.

Figure 5A:
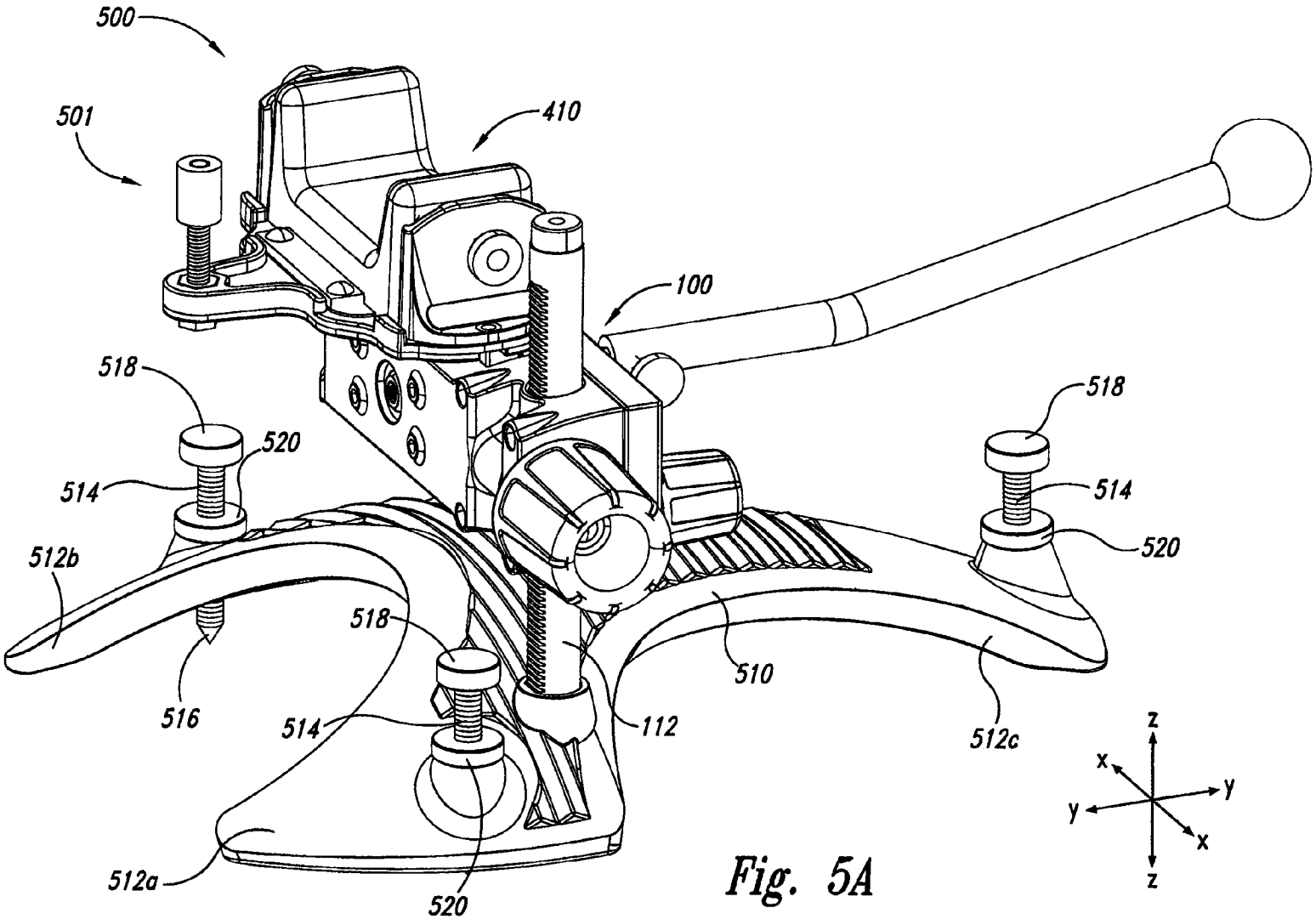
FIG. 5A is side isometric view and FIG. 5B is a top view of a shooting rest configured in accordance with an embodiment of the invention.
Figure 5B:
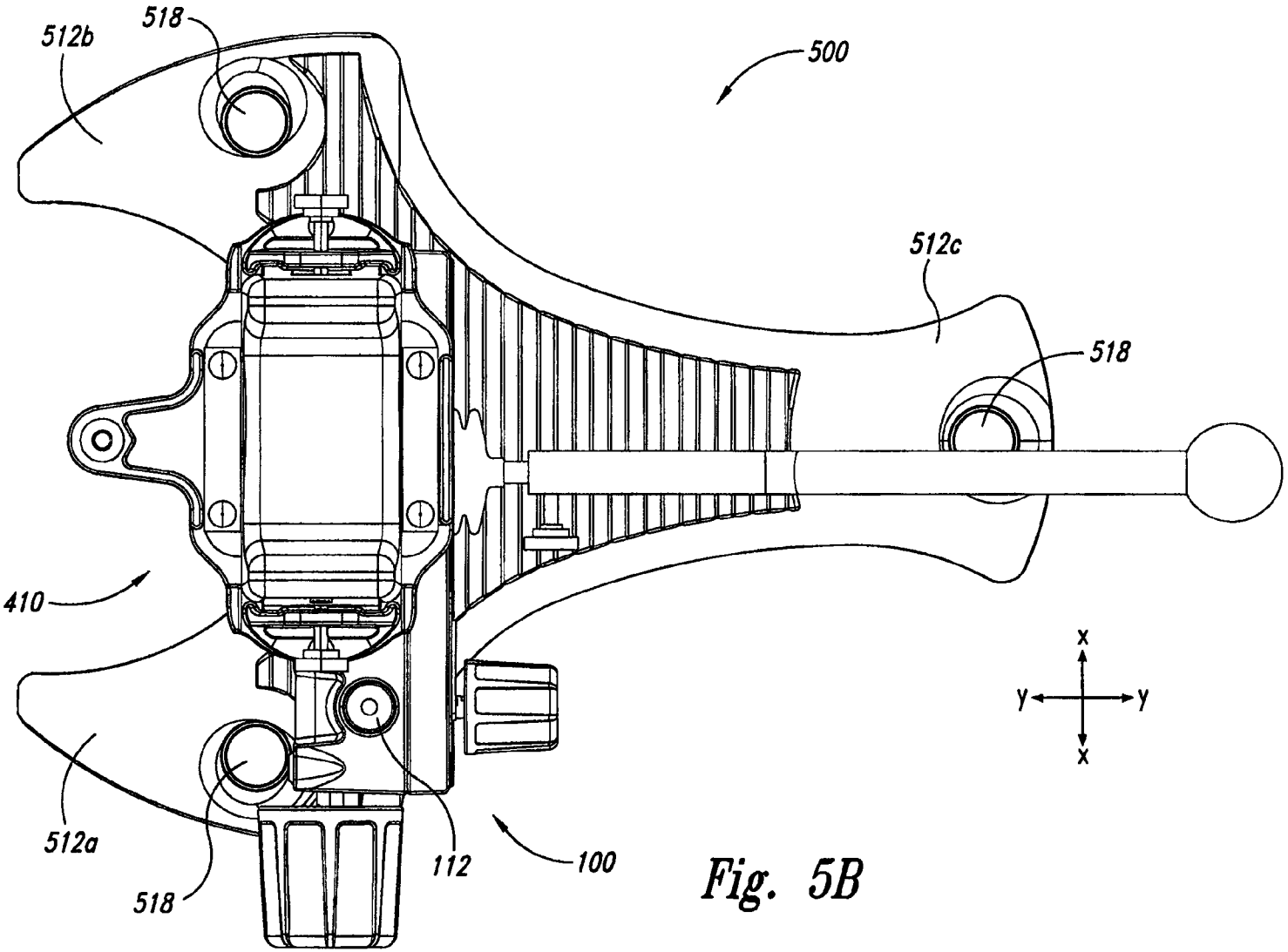

The combined embodiments of the support assemblies 100, 200*a*-200*d* and shooting rest 400 described above with reference to FIGS. 1A-4C may be used with a variety of forestock and full-length shooting rests. More specifically, FIG. 5A is a front isometric view and FIG. 5B is a top view of a shooting rest 500 configured in accordance with another embodiment of the invention. Referring to FIGS. 5A and 5B together, the shooting rest 500 includes a front support 501 comprised of the support assembly 100 and the rest assembly 410 described above with reference to FIGS. 4A-4C, coupled to a non-planar base 510. In certain aspects of the illustrated embodiment, the base 510 may have a generally concave configuration and be composed of a material suitable for a molding or casting process. For example, the base 510 may be formed from a die cast aluminum or other durable material. The illustrated base 510 includes three legs 512 (identified individually as front legs 512*a*, 512*b* and a rear leg 512*c*) spaced apart to provide a stable foundation for the front support 501. For example, in the illustrated embodiment, the front legs 512*a*, 512*b* are spaced apart in the x-direction from the front support 501, and the rear leg 512*c* extends in the y-direction from the front legs 512*a*, 512*b*. In certain embodiments, the longitudinal member 112 of the support assembly 100 is removably coupled to one of the front legs 512*a*, 512*b*. Accordingly, the support assembly 100 and the rest assembly 410 are generally centered between the front legs 512*a*, 512*b*. In other embodiments, however, the support assembly 100 and the rest assembly 410 may be positioned at other locations with reference to the base 510.

In one aspect of the illustrated base 510, each of the legs 512 has a corresponding adjustable foot 514. Each foot 514 includes an end portion 516 configured to contact a support surface (e.g., a shooting bench, the ground, etc.) and an adjustment dial 518 and a nut 520. In certain embodiments, the end portion 516 may be beveled or pointed (shown in FIG. 5A) to at least partially engage the support surface where the base 510 is positioned. The dial 518 may include a knurled or similar texture to facilitate rotating the dial 518. Rotating each dial 518 adjusts an elevation of the corresponding foot 514 in the z-direction with reference to the respective nut 520. Certain aspects of the illustrated embodiment provide several advantages over conventional shooting support bases. For example, the concave geometry of the base 510, combined with the adjustable feet 514, allows the shooting rest 500 to be used in varying conditions, including uneven support surfaces. The concave geometry may accommodate different objects under the base 510, and the feet 514 may adjust to level out the base 510. Moreover, manufacturing the base 510 with a molding or casting process may also save time and money.

Figure 6A:
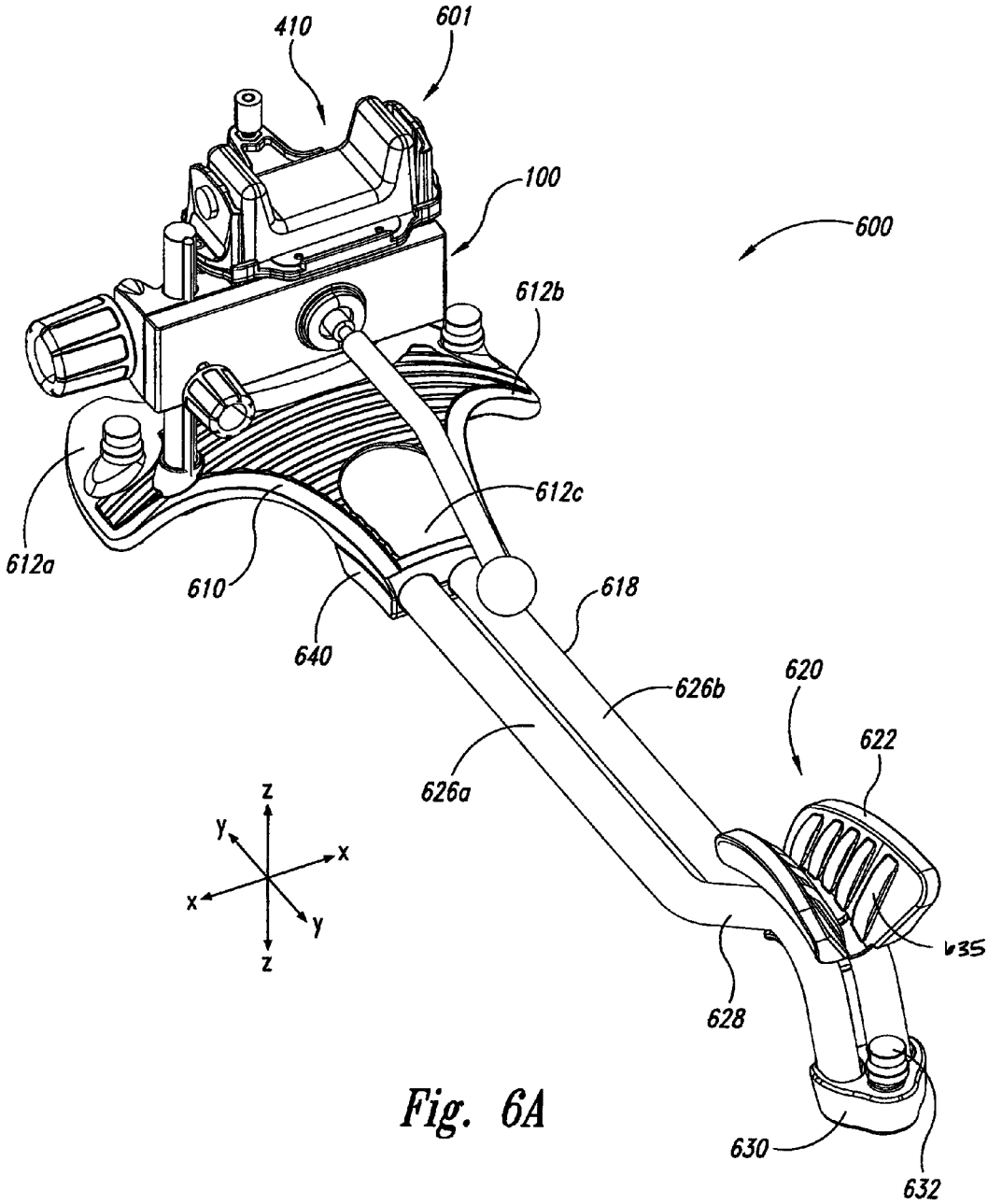
FIG. 6A is a rear isometric view and FIG. 6B is a bottom view of a full-length shooting rest configured in accordance with another embodiment of the invention.
Figure 6B:
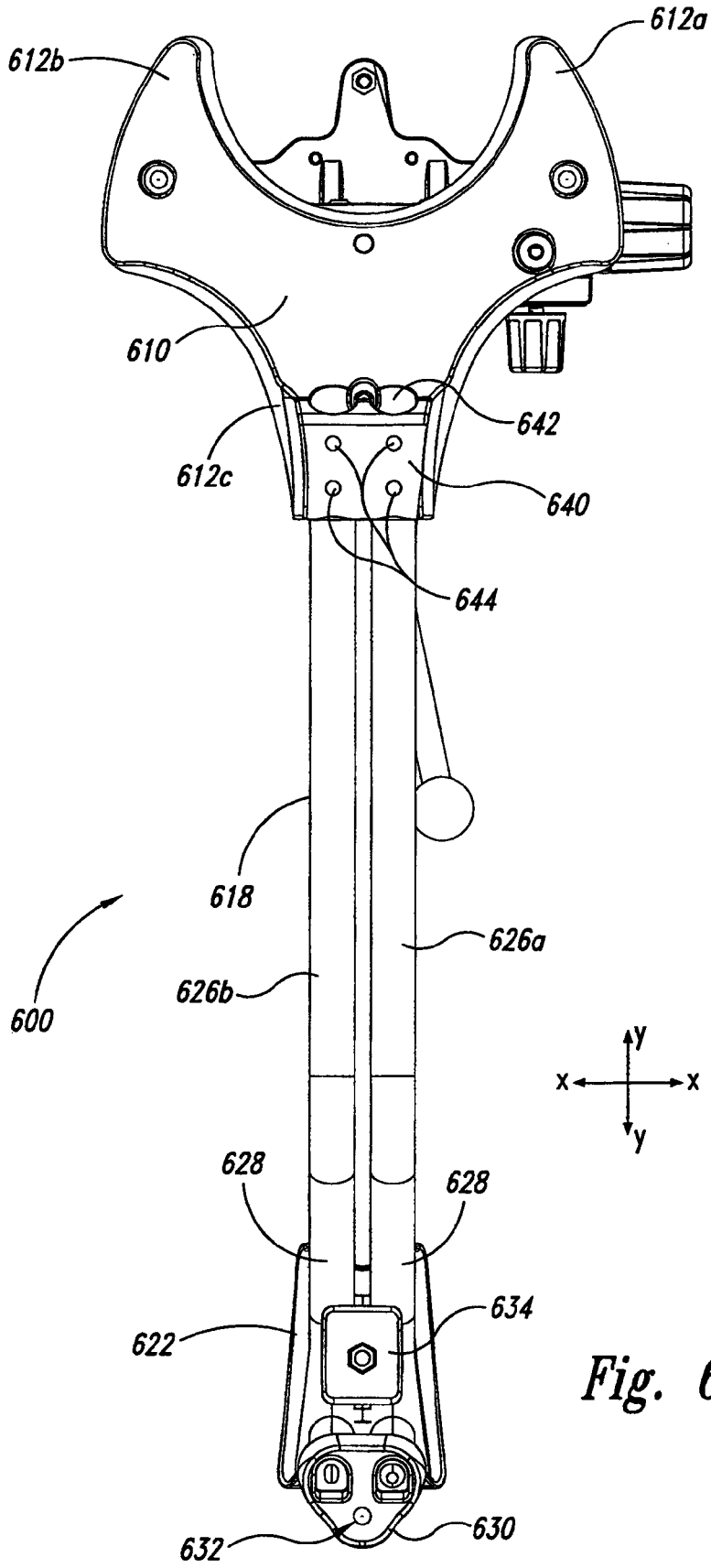

FIG. 6A is a rear isometric view and FIG. 6B is a bottom view of a full-length shooting rest 600 configured in accordance with another embodiment of the invention. Referring to FIGS. 6A and 6B together, the illustrated shooting rest 600 includes a front support 601 for carrying a forestock of a firearm, a rear support 620 for carrying a buttstock of the firearm, and a frame 618 connecting the front support 601 and the rear support 620. The front support 601 includes the support assembly 100 and the rest assembly 410 described above. The front support 601 is coupled to a front base 610 that is generally similar to the non-planar base 510 described above with reference to FIGS. 5A and 5B. For example, the illustrated base 610 includes two front legs 612*a*, 612*b* and a rear leg 612*c*. The rear leg 612*c*, however, is configured to adjustably attach to the frame 618 with an attachment plate 640. The frame 618 includes connecting sections 626 (identified individually as first and second connecting sections 626*a*, 626*b*) extending from the base 610 and attached to the rear support 620. In certain embodiments the connecting sections 626 may be made of tubular steel and be selectively coupled to the base 610 with the attachment plate 640. A plurality of fasteners 644 may clamp the connecting sections 626 between the attachment plate 640 and the base 610 at a selected position along the connecting sections 626 in the y-direction. Accordingly, a distance between the front support 601 and the rear support 620 may be adjusted in the y-direction to accommodate firearms of varying lengths.

The rear support 620 includes a rear rest 622 which may be removably attached to curved elevation portions 628 of the corresponding connecting sections 626. The curved elevation portions 628 elevate the rear rest 622 at a predetermined height in the z-direction. A rear rest attachment plate 635 couples the rear rest 622 to the curved elevation portions 628 of the connecting sections 626 at a selected distance in the y-direction. The rear support 620 also includes a base 630 configured to receive and secure end portions of each of the connecting sections 626. The base 630 may also includes a threaded adjustable foot 632. The threaded engagement of the foot 632 allows for elevation adjustment in the z-direction of the rear support 620. In certain embodiments, the adjustable foot 632 is configured to be generally similar to the adjustable feet 514 described above with reference to FIGS. 5A and 5B. Accordingly, the illustrated shooting rest 600 provides a full-length support that is adjustable for firearms of different lengths. Moreover, the components of the shooting rest 600 may be disassembled to facilitate transport and storage of the shooting rest 600.

Figure 7:
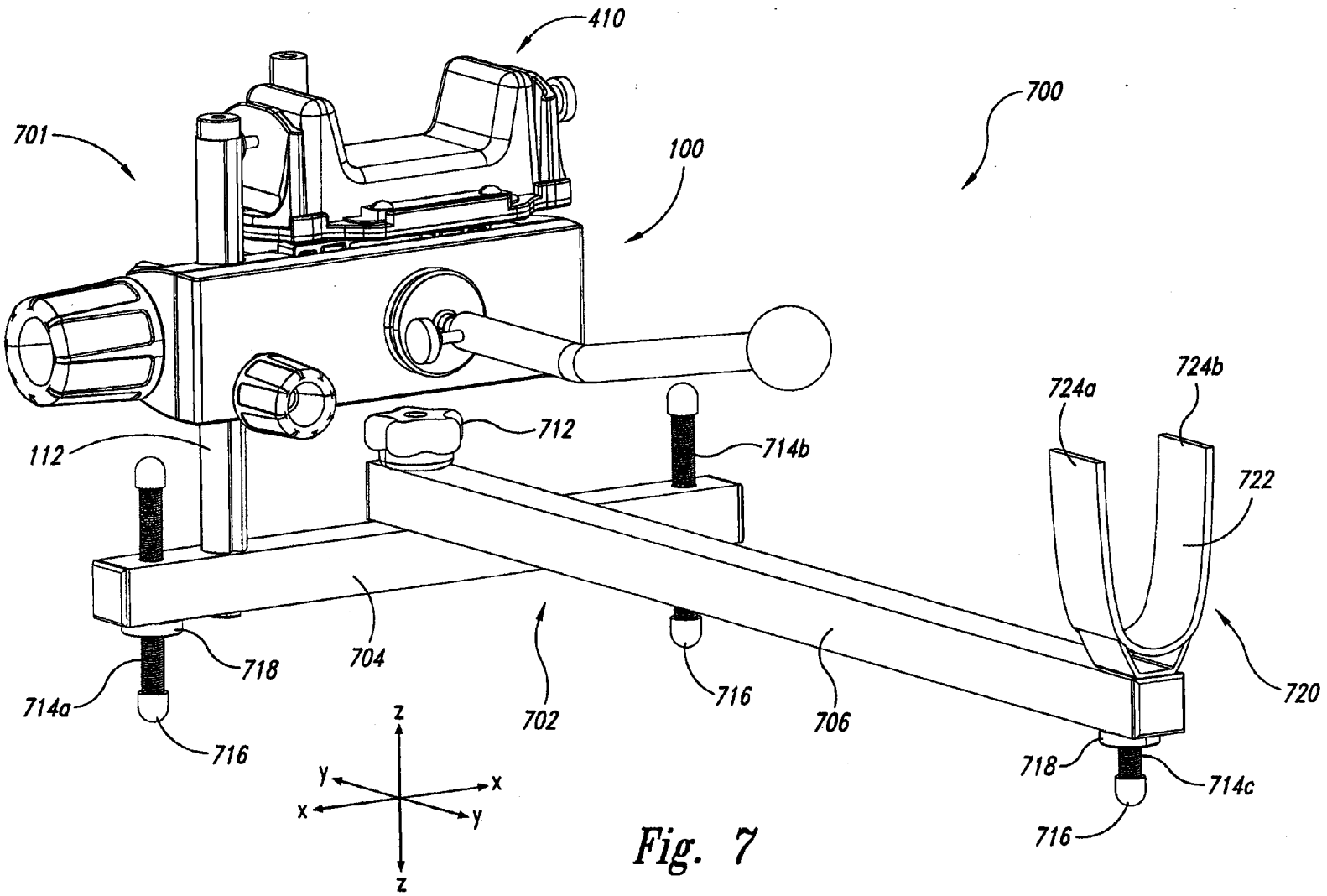
FIG. 7 is a rear isometric view of a shooting rest configured in accordance with another embodiment of the invention.

FIG. 7 is a rear isometric view of a shooting rest 700 configured in accordance with another embodiment of the invention. The illustrated shooting rest 700 includes a front support 701 for carrying the forestock of a firearm, a rear support 720 for carrying the buttstock of the firearm, and a frame 702 connecting the front and rear supports 701, 720. The front support 701 includes the support assembly 100 and the rest assembly 410 described above. The frame 702 includes a first member 704 extending in the x-direction and a second member 706 extending from the first member 704 in the y-direction. In one aspect of this embodiment, the longitudinal member 112 of the support assembly 100 is removably coupled to the first member 704. In certain embodiments, the first and second members 704, 706 may be integral components of a single piece unit. In other embodiments, and as illustrated in FIG. 7, an attachment knob 712 couples the second member 706 to the first member 704. In one aspect of this embodiment, the attachment knob 712 couples the second member 706 to the first member 704 such that the front and rear supports 701, 720 are at a fixed distance from each other. In other embodiments, however, the second member 706 may include a slot or plurality of holes (not shown) to change the distance between the front and rear supports 701, 720. In certain embodiments, the frame 702 may also be disassembled to facilitate carrying or storing the shooting rest 700.

The rear support 720 includes a support member 722 attached to a distal portion of the second member 706. In certain embodiments, the support member 722 may include a single-piece construction member having a generally U-shaped configuration. Accordingly, spaced apart end portions 724*a*, 724*b* of the support rest 720 may slightly deflect in the x-direction to accommodate firearm buttstocks of different widths. In other embodiments, however, the rear support 720 may have different configurations. The illustrated shooting rest 700 also includes three adjustable feet 714 (identified individually as first and second front feet 714*a*, 714*b* and a rear foot 714*c*) coupled to the frame 702. The feet 714 provide stability to the shooting rest 700 and threadably engage corresponding nuts 718 proximate to the frame 702. Accordingly, rotating one of the nuts 718 may drive the corresponding foot 714 in the z-direction. In the illustrated embodiment, each foot 714 includes a non-marring end portion 716. In other embodiments, however, each end portion 716 may have other configurations, such as a pointed or beveled end portion.

Figure 8:
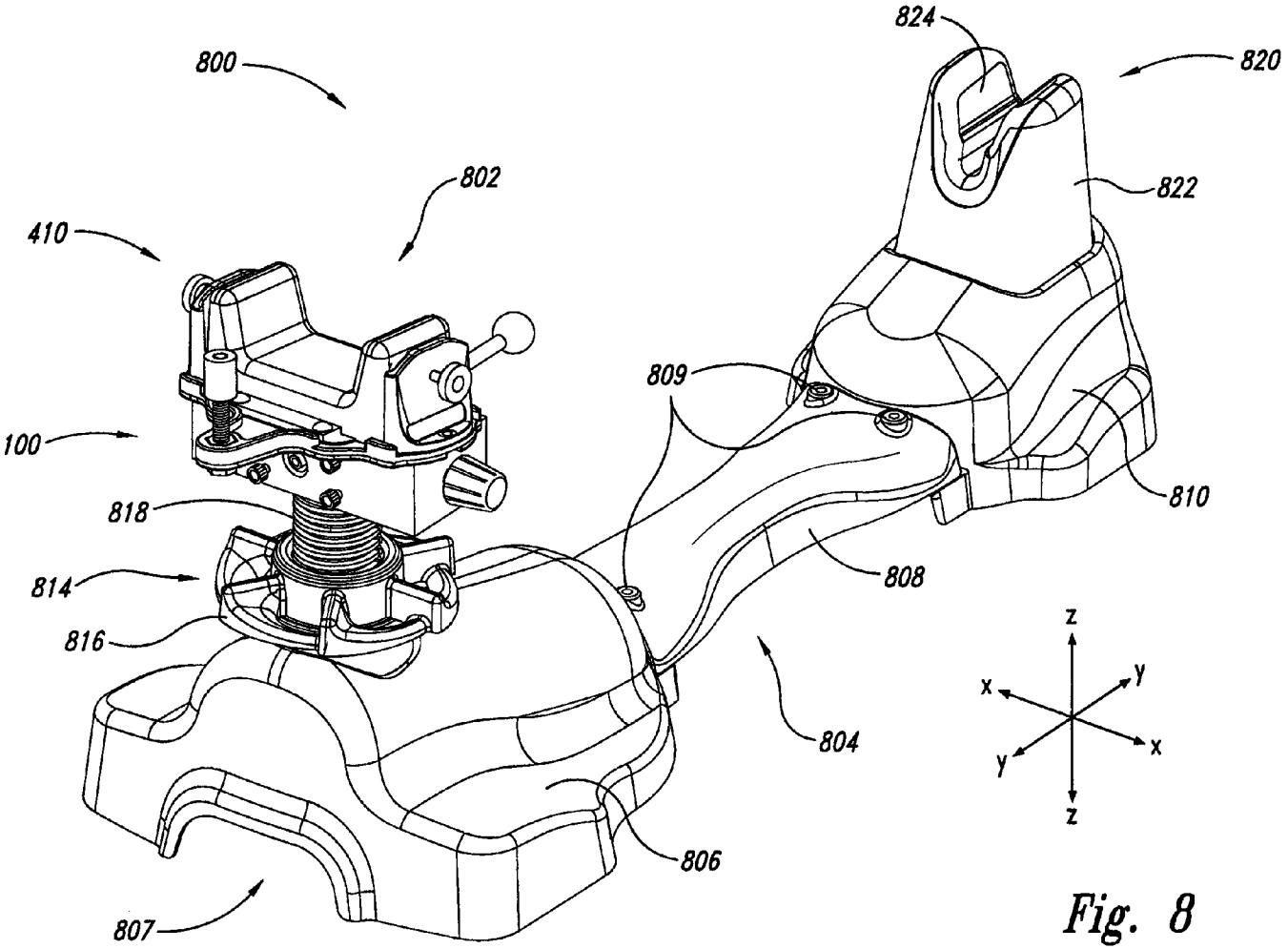
FIG. 8 is a front isometric view of a shooting rest configured in accordance with another embodiment of the invention.

FIG. 8 is a front isometric view of a shooting rest 800 configured in accordance with another embodiment of the invention. The shooting rest 800 includes a front support 802 for carrying a forestock of a firearm, a rear support 820 for carrying a buttstock of the firearm, and a frame 804 connecting the front and rear supports 802, 820. The front support 802 includes the rest assembly 410 and the support assembly 100 described above. In the illustrated embodiment, however, the support assembly 100 is coupled to an elevation assembly 814 configured to move the front support 802 in the z-direction. The elevation assembly 814 includes an adjustment dial 816 threadably engaged with a shaft 818. The shaft 818 is coupled to the support assembly 100 and a front base 806. When the adjustment dial 816 is rotated, the shaft 818 moves in the z-direction and accordingly moves the front support 802 in the z-direction. The frame 804 includes an extension member 808 coupled to the front base 806 and to a rear base 810 with a plurality of fasteners 809 (e.g., screws, bolts, rivets, etc.).

The rear support 820 includes a support member 822 coupled to the rear base 810. The rear support member 822 is configured to support the buttstock and includes a cushion 824 adapted to receive the buttstock.

In one aspect of the illustrated embodiment, certain components of the shooting rest 800 may be composed of a plastic material suitable for a molding manufacturing process. For example, the front base 806, the elevation assembly 814, the frame 804, and the rear support 820 may be formed from a thermoset material shaped in an injection molding process. In another aspect of the illustrated embodiment, these components may be disassembled when not in use to facilitate moving and storage of the shooting rest 800. In certain embodiments, the disassembled components may be nested within each other in a stacked configuration to reduce the space occupied by these components. In one aspect of this embodiment, the front base 806 includes a cavity 807 configured to receive these nested and stacked components. For example, the rear base 810, the support member 822, the extension member 808, and the elevation assembly 814 may be nested and stacked within the cavity 807 in the front base 806.

Figure 9:
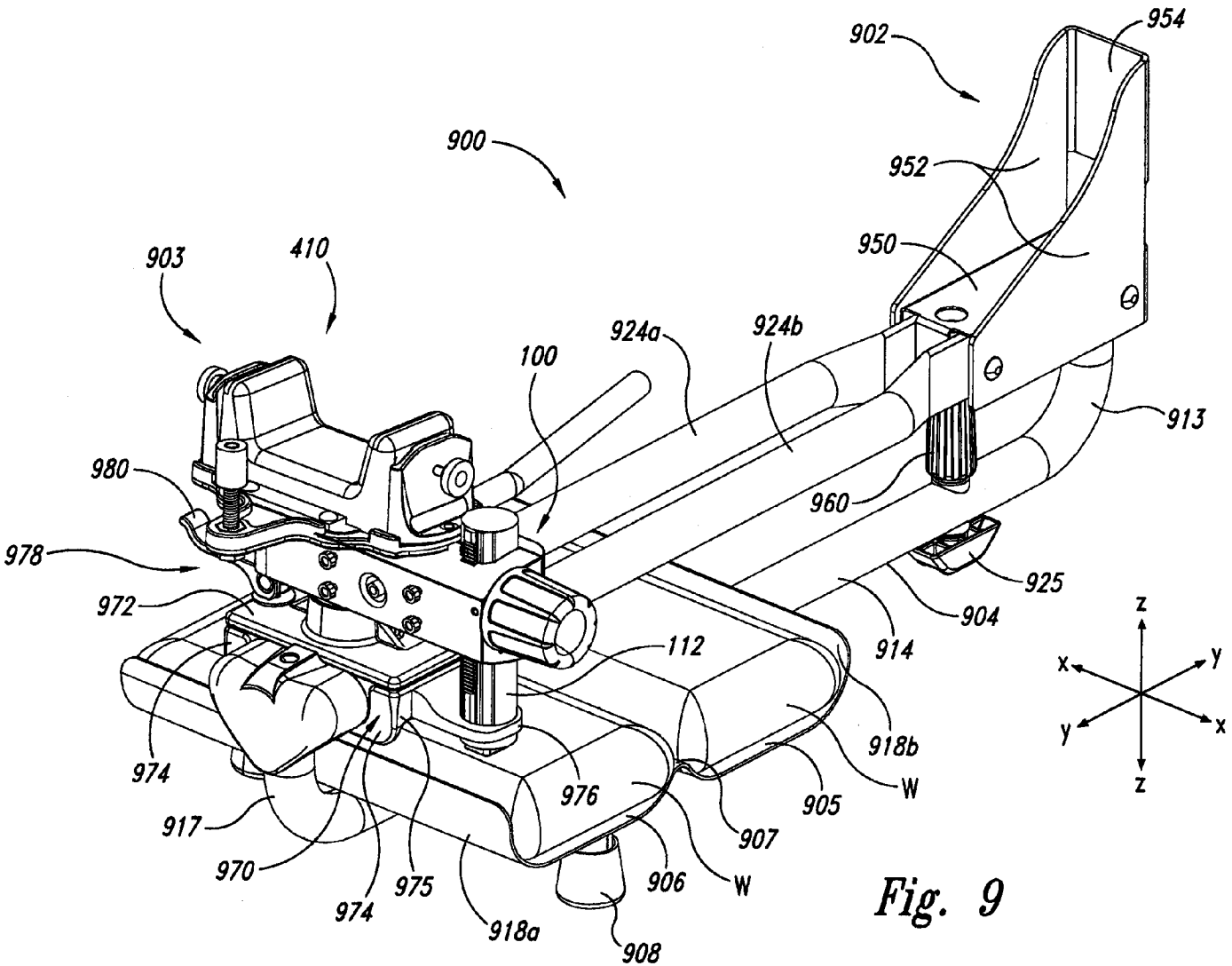
FIG. 9 is a front isometric view of a shooting rest configured in accordance with another embodiment of the invention.

FIG. 9 is a front isometric view of a shooting rest 900 configured in accordance with another embodiment of the invention. In the illustrated embodiment, the shooting rest 900 is a full-length rest configured to at least partially inhibit a recoil force resulting from firing a firearm. The illustrated shooting rest 900 includes a rear support 902 for carrying a buttstock of a firearm, a front support 903 for carrying a forestock of the firearm, a frame 904 extending between the rear support 902 and the front support 903, and a support member 905 for carrying one or more weights W. The illustrated frame 904 includes a rear vertical section 913 attached to the rear support 902, a lower horizontal section 914 projecting from the rear vertical section 913, a front vertical section 917 projecting from the lower horizontal section 914, and upper horizontal sections 924 (individually identified as first and second upper horizontal sections 924*a*, 924*b*) extending between the front vertical section 917 and the rear vertical section 913. In the illustrated embodiment, the rear vertical section 913, the lower horizontal section 914, and the front vertical section 917 are integral sections of a single member, and the first and second upper horizontal sections 924*a*, 924*b* are separate members attached to the rear and front vertical sections 913 and 917. In other embodiments, however, the frame 904 may have a different configuration including, for example, separate components.

The illustrated rear support 902 includes a horizontal wall 950, two side walls 952 projecting upward from the horizontal wall 950, and a vertical wall 954 projecting upward from the horizontal wall 950 and extending between the two side walls 952. The horizontal, side, and vertical walls 950, 952, and 954 define a pocket sized to receive a buttstock of a firearm. In certain embodiments, the horizontal, side, or vertical wall 950, 952, or 954 may be rigid panels. As such, the horizontal wall 950 is positioned to support the weight of the buttstock; the side walls 952 are positioned to prevent the buttstock from sliding in the x-direction off the horizontal wall 950; and the vertical wall 954 is positioned to inhibit rearward movement in the y-direction of the firearm during discharge. In other embodiments, however, the horizontal, side, or vertical wall 950, 952, or 954 may be formed from a flexible material.

The illustrated front support 903 includes the support assembly 100 and the rest assembly 410 described above, and a base 970. In one aspect of this embodiment, the longitudinal member 112 of the support assembly 100 is coupled to the base 970 with a securing member 976. The support assembly 100 may accordingly be adjusted in the z-direction with respect to the base 970. The illustrated base 970 includes a plate 972 and a lower portion 974 attached to the plate 972. The plate 972 is positioned over the first and second upper horizontal sections 924*a*, 924*b* of the frame 904. The lower portion 974 is positioned under the first and second upper horizontal sections 924*a*, 924*b* and includes end portions 975 projecting toward the plate 972. The plate 972 and the lower portion 974 connect the front support 903 to the first and second upper horizontal sections 924*a*, 924*b* such that the front support 903 may slide along the upper horizontal sections 924 in the y-direction. As a result, the distance between the front support 903 and the rear support 902 may be changed to accommodate firearms with different lengths or configurations. In additional embodiments, the front support 903 may not be slidably coupled to the first and second upper horizontal sections 924*a*, 924*b*.

The base 970 may also include a locking mechanism 978 (only a portion of which is shown in FIG. 9) for selectively inhibiting movement of the base 970 in the y-direction along the first and second upper horizontal sections 924*a*, 924*b*. The locking mechanism 978 may include a stop or other device for contacting the first or second upper horizontal section 924*a*, 924*b* to inhibit relative movement between the base 970 and the upper horizontal sections 924. The illustrated locking mechanism 978 includes a handle 980 configured such that a shooter may pivot the handle (a) downward to selectively lock the base 970 in a specific position and (b) upward to enable the base 970 to move in the y-direction.

The support member 905 in the illustrated embodiment is attached to the lower horizontal section 914 of the frame 904, as well as to front feet 908, and is configured to carry at least one removable weight W. Although the illustrated support member 905 is attached to the lower horizontal section 914 proximate to the front vertical section 917, in other embodiments the support member 905 may be attached to a rear portion of the frame 904. The illustrated support member 905 is a tray having front and rear lips 918*a*, 918*b* for preventing the weights from falling off the support member 905 when discharging the firearm. The support member 905 may further include a raised portion 907 extending laterally across the support member 905 in a direction generally parallel to the front and rear lips 918*a*, 918*b*. The raised portion 907 inhibits the weights from moving on the support member 905 during recoil. In additional embodiments, the support member 905 may have different configurations. For example, the support member may be a reservoir configured to receive water, sand, lead shot, pellet-like material, or other material for adding weight to the shooting rest 900. In other embodiments, portions of the frame 904 may function as the support member 905. For example, the frame 904 may include an opening configured to receive water, sand, lead shot, pellet-like material, and/or other material for adding weight to the shooting rest 900.

The illustrated shooting rest 900 also includes an angle adjustment mechanism 960 attached to the frame 904 and a rear foot 925 attached to the angle adjustment mechanism 960. The angle adjustment mechanism 960 may include a threadably coupled to the rear foot 925 such that a shooter may rotate the angle adjustment mechanism 960 to move the rear foot 925 upward or downward in the y-direction. Moving the foot adjusts the elevation of the frame 904 and the aim of the firearm in the y-direction. In other embodiments, the shooting rest 900 may not include the angle adjustment mechanism 960 or the rear foot 925.

Figure 10:
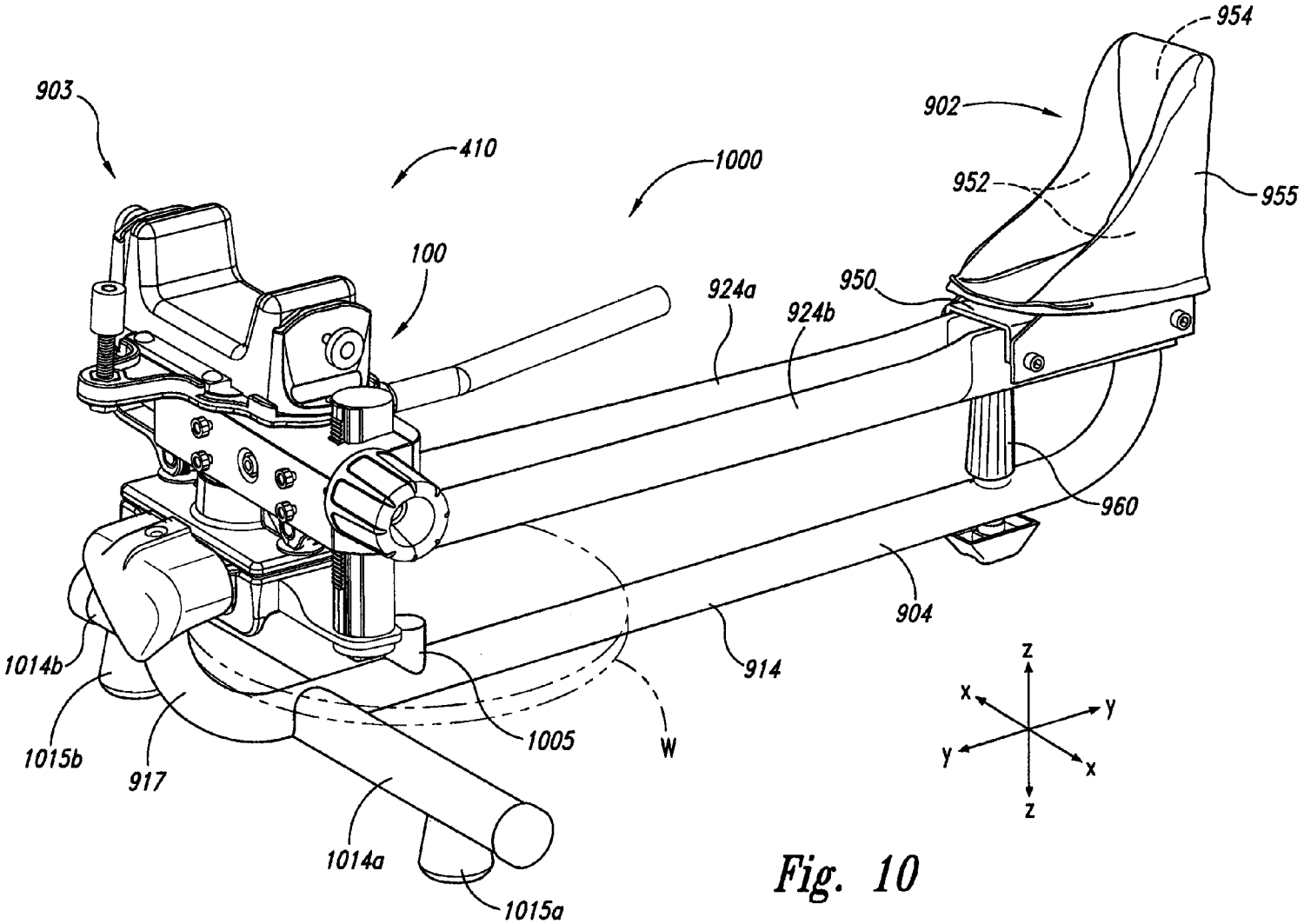
FIG. 10 is a front isometric view of a shooting rest configured in accordance another embodiment of the invention.

FIG. 10 is a front isometric view of a shooting rest 1000 configured in accordance with another embodiment of the invention. The illustrated shooting rest 1000 is generally similar to the shooting rest 900 described above with reference to FIG. 9. For example, the shooting rest 1000 includes the frame 904 connecting the rear and front supports 902 and 903. In the illustrated embodiment, however, the shooting rest 1000 includes legs 1014 (identified individually as a first leg 1014*a* and a second leg 1014*b*) extending from the lower horizontal section 914 beneath the front support 903. Feet 1015 (identified individually as first and second feet 1015*a*, 1015*b*) project from the corresponding legs 1014. The shooting rest 1000 also includes a support member 1005 attached to the frame 904. In certain embodiments, the support member 1005 projects from the lower horizontal section 914 of the frame 904 in the z-direction and may be an integral part of the frame 904 or a separate component attached to the frame 904. The support member 1005 is configured to be received within an aperture of a removable weight W (shown in broken lines) to secure the weight W to the frame 904. In other embodiments, the support member 1005 may interact with or engage a removable weight W having a different configuration such that the support member 1005 releasably secures the weight W to the frame 904. In additional embodiments, the shooting rest 1000 may include multiple support members 1005 projecting from the lower horizontal section 914 or other portions of the frame 904. For example, in one such embodiment, the support members 1005 may project from the legs 1014*a*, 1014*b* of the frame 914, or the legs 1014*a*, 1014*b* may include a section for receiving the weights W.

The shooting rest 1000 illustrated in FIG. 10 also includes a sleeve 1055 over portions of the rear support 902. More specifically, the sleeve 1055 may be placed over the horizontal, side, and vertical walls 950, 952, and 954. The sleeve 1055 may be composed of a non-marring and flexible material, such as a fabric or leather, to receive the buttstock of the firearm.

Figure 11:
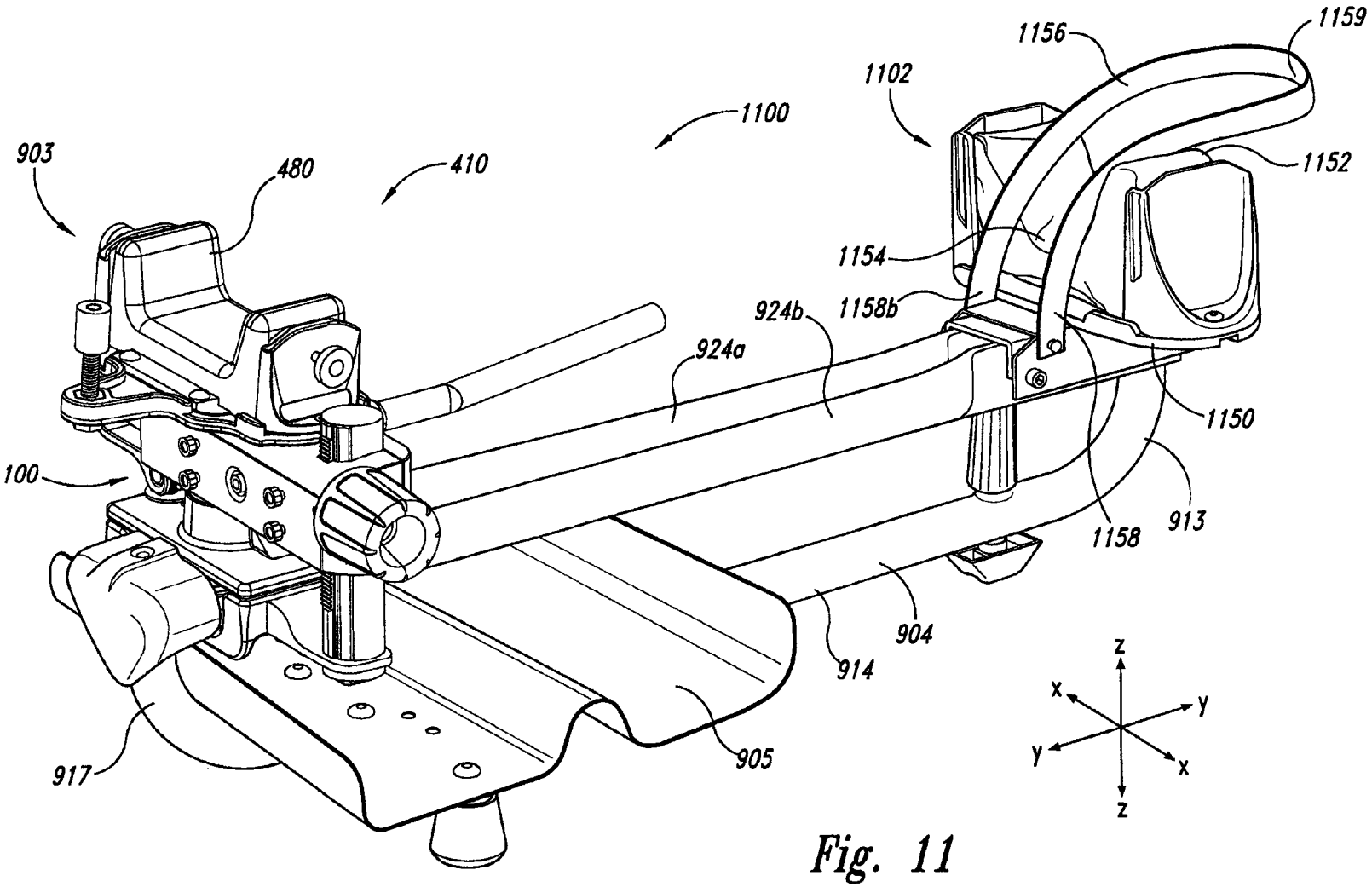
FIG. 11 is a front isometric view of a shooting rest configured in accordance with another embodiment of the invention.

FIG. 11 is a front isometric view of a shooting rest 1100 configured in accordance with another embodiment of the invention. The illustrated shooting rest 1100 is generally similar to the shooting rest 900 described above with reference to FIG. 9. For example, the shooting rest 1100 includes a rear support 1102, the front support 903, the frame 904 connecting the rear and front supports 1102 and 903, and the support member 905 attached to the frame 904. The illustrated rear support 1102, however, includes a plate 1150 attached to the frame 904 and a support member 1152 (e.g., a shooting bag) attached to the plate 1150. The support member 1152 may be generally similar to the support member 480 of the rest assembly 410 of the front support 903. The rear support 1102 also includes a strap 1156 configured to wrap around the buttstock of the firearm and inhibit rearward movement in the y-direction of the firearm during discharge. The illustrated strap 1156 includes a first end portion 1158*a* and a second end portion 1158*b* attached to at least one of the plate 1150, bag 1152, or frame 904. The strap 1156 also includes an intermediate section 1159 between the end portions 1158*a*, 1158*b* and positioned to contact the butt of the firearm. In other embodiments, the shooting rest 1100 may include multiple straps that extend between the frame 904 and the firearm to inhibit movement of the firearm during discharge.

Figure 12:
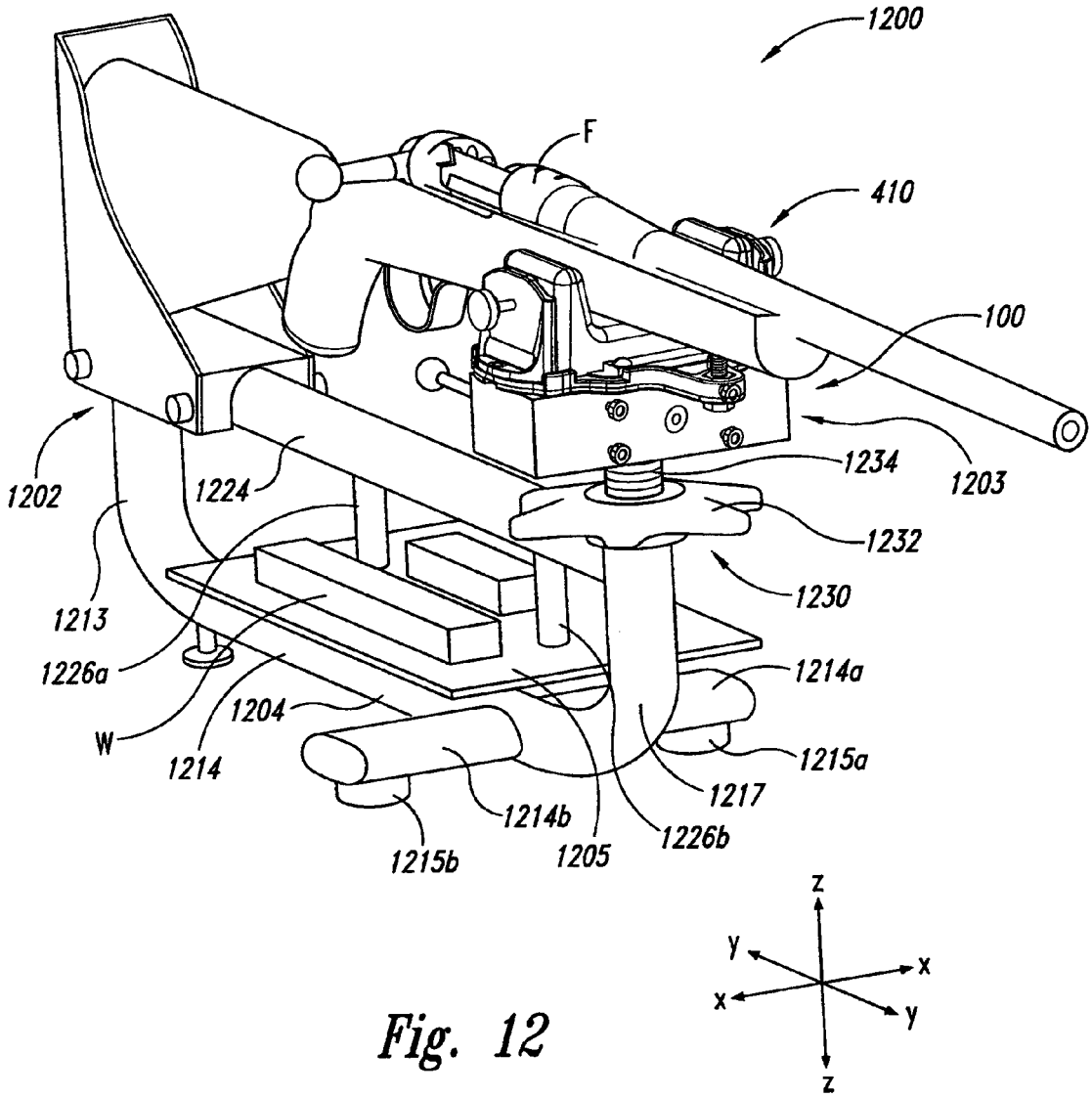
FIG. 12 is a front isometric view of a firearm and a shooting rest configured in accordance with another embodiment of the invention.

FIG. 12 is a front isometric view of a shooting rest 1200 configured in accordance with another embodiment of the invention. The shooting rest 1200 includes features generally similar to features of the shooting rests described above with reference to FIGS. 9-11. In the illustrated embodiment, however, a firearm F is shown in the shooting rest 1200, and the shooting rest 1200 includes a frame 1204 that keeps a rear support 1202 for carrying the buttstock at a fixed distance from a front support 1203 for carrying the forestock. The illustrated frame 1204 includes a rear vertical section 1213 attached to the rear support 1202, a lower horizontal section 1214 extending from the rear vertical section 1213 to a front vertical section 1217 attached to the front support 1203, and an upper horizontal section 1224 extending between the front vertical section 1217 and the rear vertical section 1213. In the illustrated embodiment, the rear vertical section 1213, the lower horizontal section 1214, and the front vertical section 1217 are integral sections of a single member. The upper horizontal section 1224 is a separate member attached to the front and rear vertical sections 1217, 1213. In other embodiments, however, the upper horizontal section 1224 may also be an integral member with the other sections of the frame 1204. The frame 1204 also includes legs 1214 (identified individually as first and second legs 1214*a*, 1214*b*) projecting from the lower horizontal section 1214, and corresponding feet 1215 (identified individually as first and second feet 1215*a*, 1215*b*) projecting from the legs 1214 to provide stability to the shooting rest 1200.

The illustrated shooting rest 1200 also includes a support member 1205 attached to the upper horizontal section 1224, rather than the lower horizontal section 1214, with a plurality of connectors 1226 (identified individually as first and second connectors 1226*a*, 1226*b*). The illustrated support member 1205 is a tray or plate configured for supporting one or more removable weights W. In certain embodiments, the weights W may rest on the support member 1205 detached from the support member 1205. In other embodiments, however, the weights W may be attached to the support member 1205 with suitable fasteners (e.g., straps). Although the illustrated support member 1205 is a generally flat member, in other embodiments the support member may include one or more lips, recesses, protrusions, and/or other features for retaining the weights W during discharge of the firearm F, similar to the embodiments described above. In additional embodiments, the support member 1205 may not be positioned between the lower and upper horizontal sections 1214 and 1224, but rather the support member 1205 may be positioned between the upper horizontal section 1224 and the firearm F. Alternatively, in other embodiments, the support member 1205 may be attached to the lower horizontal section 1214 in addition to or in lieu of the upper horizontal section 1224.

The illustrated rear support 1202 is configured to be generally similar to the rear support 902 illustrated in FIGS. 9 and 10. The illustrated front support 1203, however, includes an elevation assembly 1230, coupled to the support assembly 100 and the rest assembly 410, and configured to be generally similar to the elevation assembly 814 illustrated in FIG. 8. For example, the illustrated elevation assembly 1230 includes an adjustment dial 1232 threadably engaged with a shaft 1234 to move the front support 1203 in the y-direction.

Figure 13:
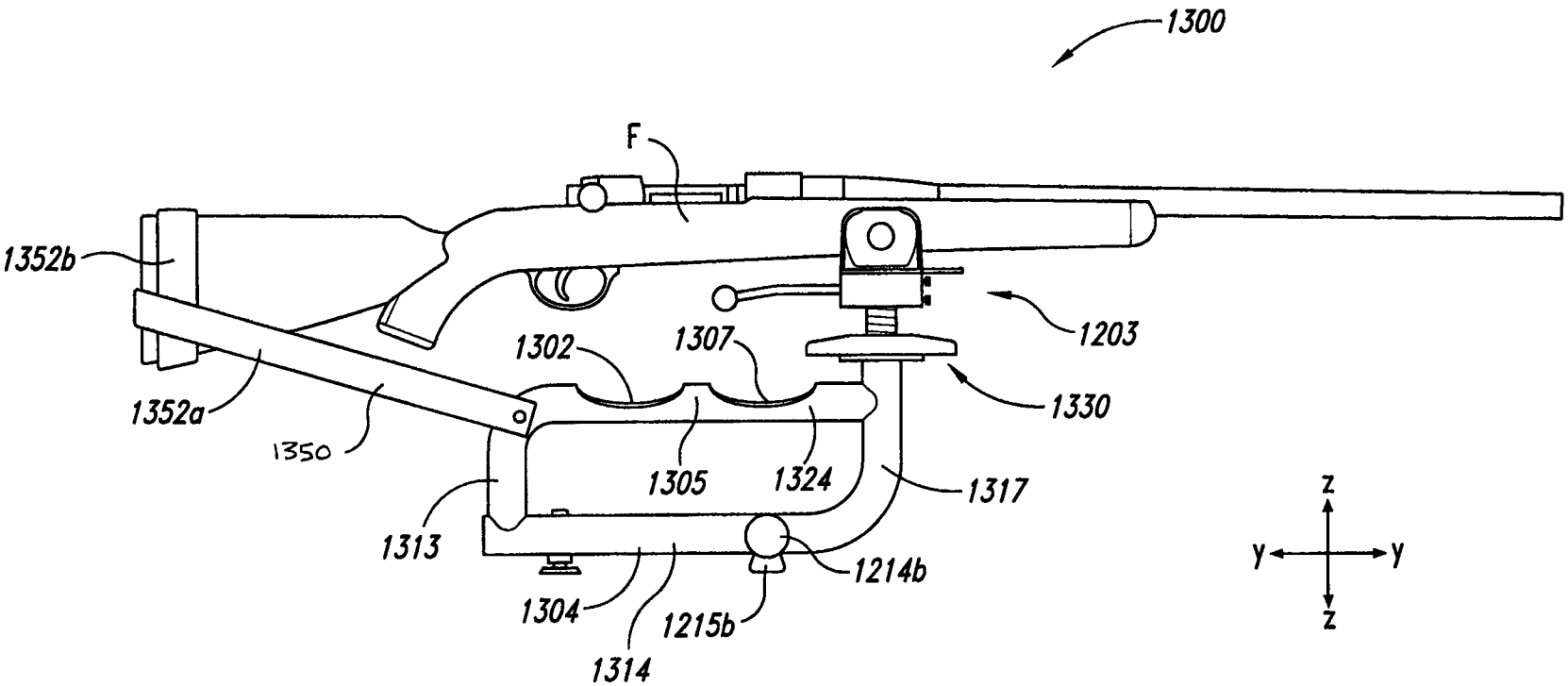
FIG. 13 is a side elevational view of a firearm and a shooting rest configured in accordance with another embodiment of the invention.

FIG. 13 is a side view of a shooting rest 1300 configured in accordance with another embodiment of the invention. The shooting rest 1300 is generally similar to the shooting rest 1200 described above with reference to FIG. 12. For example, the shooting rest 1300 includes the front support 1203 and the elevation assembly 1230 illustrated in FIG. 12 for carrying the forestock of the firearm F. The shooting rest 1300 also includes a frame 1304 for supporting the front support 1203, and a support member 1305 for carrying one or more removable weights (not shown). The frame 1304 includes a front vertical section 1317 for supporting the front support 1203, and a lower horizontal section 1314 extending from the front vertical section 1317. The support member 1305 includes a rear vertical section 1313 extending from the lower horizontal section 1314 of the frame 1304, and an upper horizontal section 1324 between the rear vertical section 1313 and the front vertical section 1317. In certain embodiments the lower horizontal section 1314 and the front vertical section 1317 may be integral components of a single unit forming the frame 1304, and the rear vertical section 1313 and the upper horizontal section 1324 may be integral components of a single unit forming the support member 1305. In other embodiments however, these sections may include separate members attached to each other. The support member 1305 includes a plurality of recessed surfaces 1307 configured to support and hold removable weights (not shown) during the firearm discharge. In other embodiments, the support member 1305 may have a different configuration for carrying one or more removable weights. For example, the support member 1305 may include a plurality of protrusions, bosses, hooks, wings, and/or other devices for interfacing with the weights.

In the embodiment illustrated in FIG. 13, the shooting rest 1300 further includes a flexible member 1350 for inhibiting rearward movement in the y-direction of the firearm F during discharge. The illustrated member 1350 includes a first portion 1352*a* extending between the support member 1305 and the buttstock of the firearm F and a second portion 1352*b* extending around the buttstock in a direction generally transverse to the first portion 1352*a*. In certain embodiments, the flexible member 1350 may be a strap, cord, belt, or other flexible member that is selectively attached to the buttstock of the firearm F. In other embodiments, the flexible member 1350 may have a different configuration. For example, the flexible member 1350 may include a pocket into which at least a portion of the buttstock may be received. Although the illustrated shooting rest 1300 does not include a rear support for carrying the buttstock of the firearm F, in other embodiments the shooting rest 1300 may include a rear support.

Figure 14:
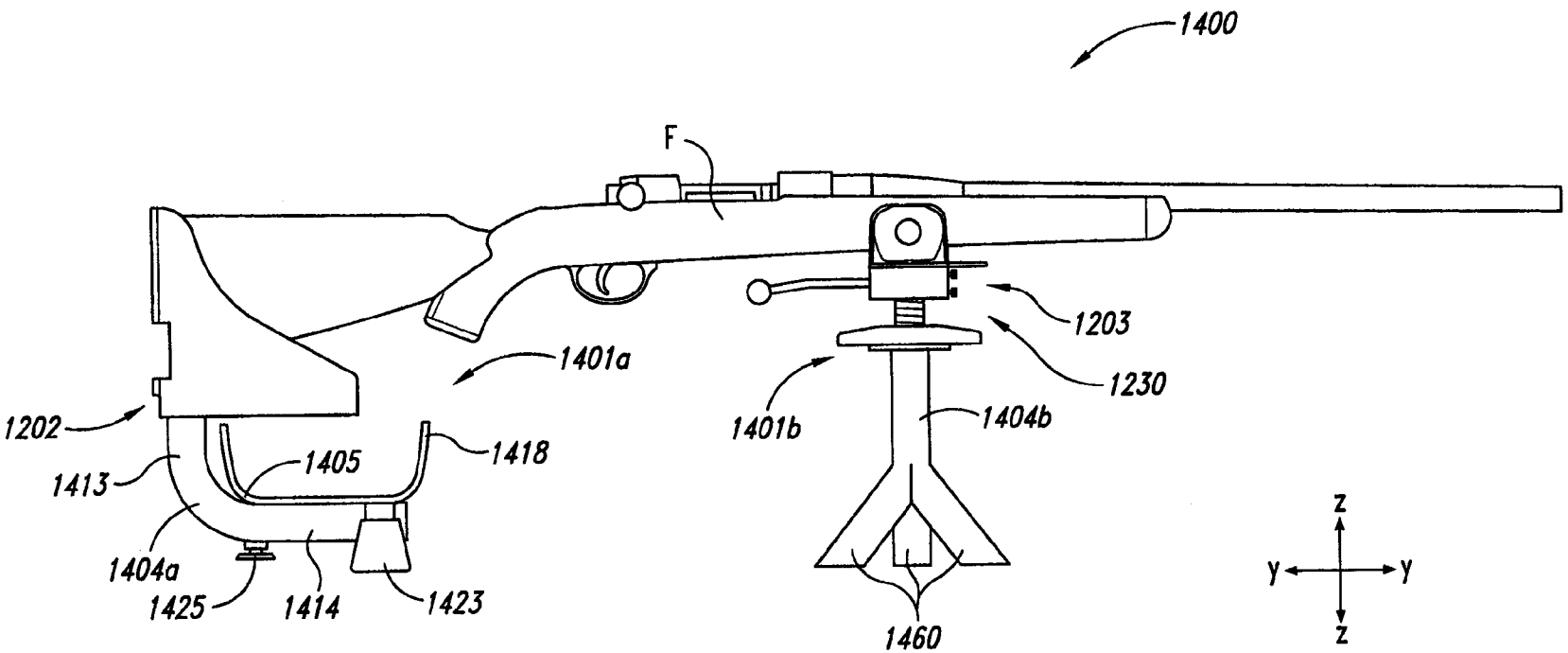
FIG. 14 is a side elevational view of a firearm and a shooting rest configured in accordance with another embodiment of the invention.

FIG. 14 is a side view of a shooting rest 1400 configured in accordance with another embodiment of the invention. The illustrated shooting rest 1400 includes a first portion 1401*a* and a second portion 1401*b* spaced apart and separate from the first portion 1401*a*. The first portion 1401*a* includes the rear support 1202 illustrated in FIG. 12, a first frame 1404*a* for supporting the rear support 1202, and a support member 1405 for carrying one or more removable weights (not shown). The first frame 1404*a* includes a vertical section 1413 attached to the rear support 1202 and a horizontal section 1414 extending from the vertical section 1413. The support member 1405 is attached to the horizontal section 1414 to receive the one or more weights and may be configured generally similar to some of the embodiments of the support members described above. The first portion 1401*a* may also include one or more front feet 1423 attached to the support member 1405 and a rear foot 1425 attached to the first frame 1404*a*. The front and rear feet 1423, 1425 may accordingly stabilize the first portion 1401*a* of the shooting rest 1400. The second portion 1401*b* of the shooting rest 1400 includes the front support 1203 and elevation assembly 1230 illustrated and described above with reference to FIG. 12. The front support 1203 also includes a plurality of legs 1460 for stabilizing the second portion 1401*b*. In additional embodiments, the second portion 1401*b* may include a support member configured to receive one or more removable weights.

Figure 15:
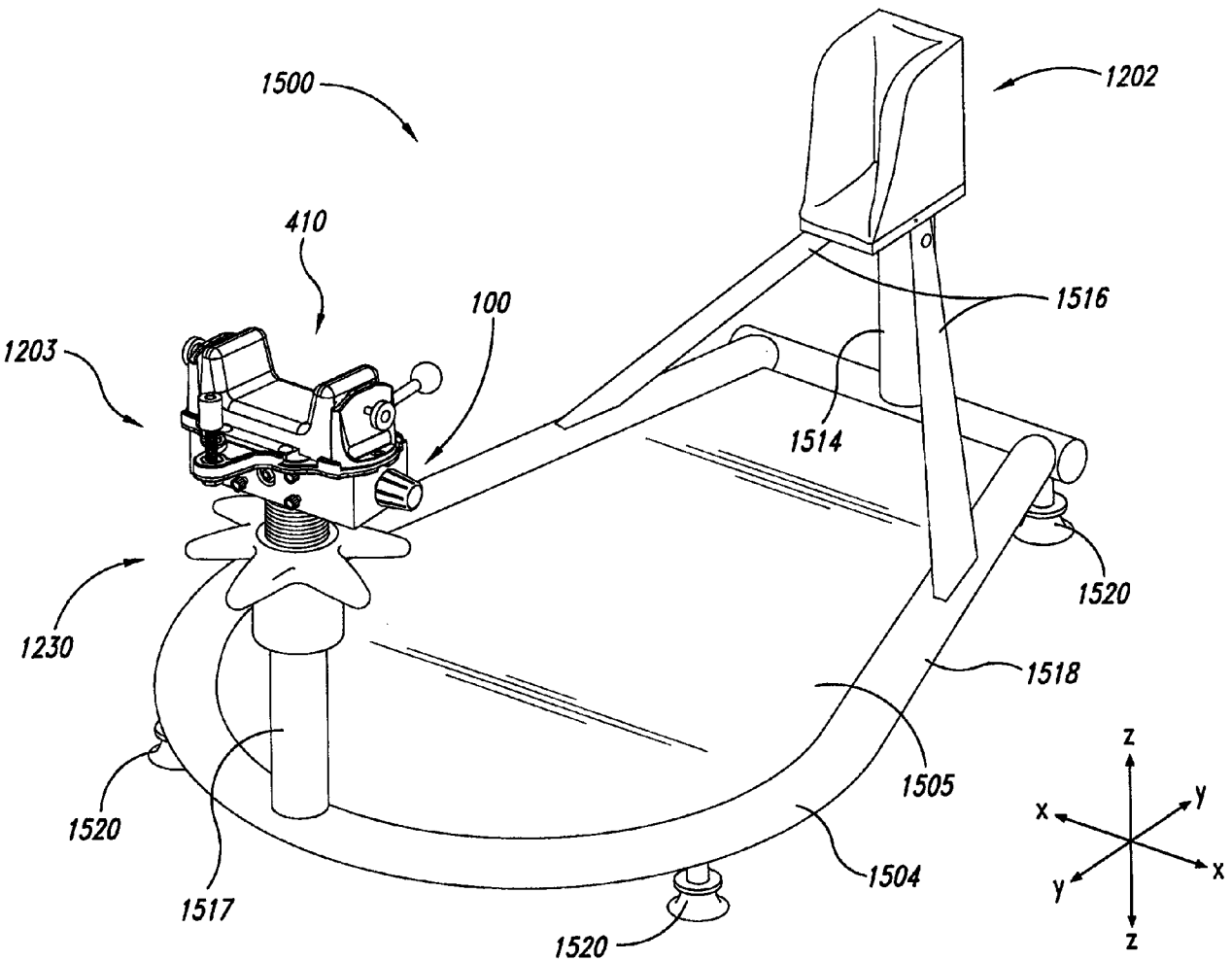
FIG. 15 is a front elevational view of a shooting rest configured in accordance with another embodiment of the invention.

FIG. 15 is a front isometric view of a shooting rest 1500 configured in accordance with another embodiment of the invention. The illustrated shooting rest 1500 includes certain features generally similar to some of the embodiments described above. For example, the shooting rest 1500 includes the front support 1203, the elevation assembly 1230, and the rear support 1202 illustrated in FIG. 12. In the illustrated embodiment, a frame 1504 couples the front support 1203 to the rear support 1202. The frame 1504 includes a front vertical member 1517 extending from the elevation assembly 1230, and a horizontal periphery member 1518 coupled to the front vertical member 1517. A rear vertical member 1514 is coupled to the horizontal periphery member 1518 and extends to the rear support 1202. A support member 1505 is coupled to the horizontal periphery member 1518 covering an inner area of the horizontal periphery member 1518 and configured to support one or more removable weights (not shown in FIG. 15). Support members 1516 connect the horizontal periphery member 1518 to the rear vertical member 1514 or the rear support 1202 to reinforce the rear vertical member 1514 when firing the firearm. A plurality of adjustable feet 1520 are also coupled to the frame 1504 having features generally similar to the adjustable feet described above.

From the foregoing, it will be appreciated that specific embodiments of the invention have been described herein for purposes of illustration, but that various modifications may be made without deviating from the scope of the disclosure. Where the context permits, singular or plural terms may also include the plural or singular terms, respectively. Unless the word "or" is expressly limited to mean only a single item exclusive from other items in reference to a list of at least two items, then the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same features or other types of features and components are not precluded.

Furthermore, particular features or aspects described herein in the context of particular embodiments may be combined or eliminated in other embodiments. Further, while advantages associated with certain embodiments have been described in the context of those embodiments, other embodiments may also exhibit such advantages, and not all embodiments need necessarily exhibit such advantages to fall within the scope of the invention. Accordingly, the disclosure is not limited, except as by the appended claims.

We claim:

1. A shooting rest comprising:

a front support for supporting a forestock of a firearm, the front support including a rest assembly having first and second independently adjustable upright members, and a support assembly coupled to the rest assembly, wherein the support assembly is configured to move the rest assembly in any direction in a plane generally transverse to a longitudinal axis of the firearm;

a rear support for supporting a buttstock of the firearm; and a frame coupled to the front support and the rear supports.

2. The shooting rest of claim 1 wherein:

the front support further comprises a non-planar front base coupled to the support assembly, wherein the front base has a generally concave geometry and includes first and second adjustable front feet;

the frame further comprises first and second connecting members extending from the front support to the rear support;

the front support is selectively coupled to the first and second connecting members such that the front support may move in a direction generally parallel to the longitudinal axis of the firearm; and the rear support is coupled to curved elevated portions of the first and second connecting members.

3. The shooting rest of claim 1 wherein the frame connects the front support at a fixed distance from the rear support.

4. The shooting rest of claim 1, further comprising:

a front base releasably coupled to the front support, wherein the front base includes a cavity and is composed of a plastic material; and a rear base releasably coupled to the rear support, wherein the rear support, the rear base, and the frame are each composed of a plastic material and include a geometry configured to at least partially fit in a nested and stacked configuration within the cavity in the front base when the shooting rest is disassembled.

* * * * *